US006460651B1

(12) United States Patent
Sahyoun

(10) Patent No.: US 6,460,651 B1
(45) Date of Patent: Oct. 8, 2002

(54) PASSIVE SPEAKER SYSTEM

(76) Inventor: Joseph Yaacoub Sahyoun, 3031 Hopkins Ave., Redwood City, CA (US) 94062-2835

( * ) Notice: Subject to any disclaimer, the term of this patent is extended or adjusted under 35 U.S.C. 154(b) by 0 days.

(21) Appl. No.: 09/542,155

(22) Filed: Apr. 4, 2000

Related U.S. Application Data

(63) Continuation-in-part of application No. 09/201,398, filed on Nov. 30, 1998, now Pat. No. 6,044,925.

(51) Int. Cl.[7] ..... G10K 13/00; H04R 7/00

(52) U.S. Cl. ..... 181/157; 181/172; 181/163; 381/423; 381/431

(58) Field of Search ..... 181/157, 155, 181/156, 153, 171, 172, 173, 160, 163, 166, 144, 146; 381/335, 338, 349, 352, 160, 186, 386, 392, 398, 431, 429

(56) References Cited

U.S. PATENT DOCUMENTS

| | | | | | |
|---|---|---|---|---|---|
| 1,759,725 | A | * | 5/1930 | Young et al. | |
| 2,896,737 | A | * | 7/1959 | Gellman | 181/31 |
| 3,154,173 | A | * | 10/1964 | Petrie | 181/32 |
| 4,207,963 | A | | 6/1980 | Klasco | |
| 4,433,214 | A | * | 2/1984 | Jasinski | 179/115.5 ES |
| 4,837,839 | A | * | 6/1989 | Andrews | 381/199 |
| 5,191,177 | A | * | 3/1993 | Chi | 181/153 |
| 5,719,946 | A | * | 2/1998 | Terauchi et al. | 381/195 |
| 5,739,481 | A | * | 4/1998 | Baumhauer, Jr. et al. | 181/148 |
| 5,749,433 | A | * | 5/1998 | Jackson | 181/156 |
| 6,044,925 | A | * | 4/2000 | Sahyoun | 181/157 |
| 6,111,969 | A | * | 8/2000 | Babb | 381/396 |
| 6,160,898 | A | * | 12/2000 | Bachmann et al. | 381/425 |

FOREIGN PATENT DOCUMENTS

| | | | | |
|---|---|---|---|---|
| JP | 55046652 | A * | 4/1980 | 381/398 |
| JP | 01319395 | A * | 12/1989 | 381/432 |
| JP | 11262085 | A * | 9/1999 | H04R/7/02 |

* cited by examiner

*Primary Examiner*—Robert E. Nappi
*Assistant Examiner*—Elgardo San Martin
(74) *Attorney, Agent, or Firm*—Allston L. Jones

(57) ABSTRACT

A passive radiator and method is disclosed which improves frequency response linearity and greatly reduces the possibility that wobble of a passive radiator which will occur without the displacement limitations of a spider containing speaker structure. Two substantially fiat surfaced speaker diaphragms are tied together and supported by two sets of surrounds oriented in opposite directions to reduce the non-linearity in the surround spring rate Hand improve low frequency sound generation. A vent (pressure relief system is provided to improve the frequency response and range of motion of the passive speaker system. A progressive surround roll arrangement provides for improved sound quality by utilizing localized position based extension while maintaining the range of maximum travel during resonance.

14 Claims, 20 Drawing Sheets

Extension V. Force Comparison
Do
Dm
Drm
Dro
CTR 214
212
216
250
244
Force in units of Force
Extension in units of length
0
10
20
30
40
50
60
70
0.2
0.4
0.6
0.8
1
1.2

232
230
236
234

242
246
240
236
238
234

248
252
246

254
252

PASSIVE SPEAKER SYSTEM

RELATED U.S. APPLICATIONS

This is a Continuation In Part application of application Ser. No. 09/201,398, filed Nov. 30, 1998 now U.S. Pat. No. 6,044,925.

FIELD OF THE INVENTION

This invention relates to loud speakers and in particular to the construction of passive radiators in closed loud speaker systems.

BACKGROUND OF THE INVENTION

A goal of sound reproduction equipment is to provide a life-like sound quality to the listener. Life-like sound quality is understood to be best achieved when a sound system including the speakers have a flat frequency response curve throughout the range of sound frequencies audible to the human ear, generally 20 to 20,000 Hz. A normal speaker cabinet has an electro magnetically driven speaker cone sealed to an opening in the wall of a sealed cabinet. This arrangement provides a drooping frequency response curve (e.g., 22 in the graph 20 of FIG. 1).

The graph 20 of FIG. 1 represents a comparison of sound level verses frequency (i.e., frequency response). The plot 22 shows the drooping response for a closed cabinet system. Over the years, in an effort to improve sound quality low, mid, and high range speakers have been placed in separate cabinets or compartments. Each of those separate cabinets or compartments could then be tuned by creating ports with or without tubes in them into the cabinet to improve the frequency response. At low frequencies, the use of open ports or open ports and tubes into the speaker cabinet becomes unmanageable because of the large amount of air mass that needs to be moved to provide adequate tuning. As an example, an ideal cabinet size to hear low frequencies might be larger than the room in which the listener was sitting. In an effort to offset the effects of a rigid sealed cabinet and avoid the spatial requirements necessary when attempting to create ports or tube ports with speakers at low frequencies, passive radiators (generally configured like speakers, but without the electro mechanical driver) have been placed in a secondary opening of the walls of the speaker cavity to reduce the drop-off of the loudness at low frequencies. An example of the improvement in the frequency response when such a passive radiator is installed is shown as plot 24 in FIG. 1. An example of the improvement in the frequency response attributable to the installation of a prior art passive radiator can be understood by reviewing plot 26 in FIG. 2. Note that the drop in the frequency response curve at lower frequencies in plot 26 is very severe before the range of inaudible frequencies 28 is reached. In this configuration, AREA2, the area under the curve to the right of the peak above a minimum loudness level is larger than AREA1 which is the area under the curve to the left of the peak. This imbalance is indicative of the relative distortion that can be heard as the loudness of the passive radiator nosedives and falls below an audible loudness. The low frequency loudness and energy are not balanced with the high frequency loudness and energy. The area under the curves provide a measure of the imbalance. Recent trends in the audio systems market have been leaning towards enhancing the bass or sub-woofer response of the audio reproduction systems, so that even if a sound is below the low limit of the range of audible sound, the sound level is high so that the listener, although he or she cannot "hear" the sound in their ears, they can "feel" the sound as parts of their body are hit by the low frequency waves. At low frequencies, a limitation of passive radiators has been that the low frequencies require large displacements of the moveable radiator elements. Such large displacements can exceed the available range of motion of moveable radiator elements. For example, in FIGS. 4, 5, and 6, a speaker spider 62 at its perimeter is attached to the back end of a speaker basket 50 while the spider's center edge (or core) it is attached to the back end of a speaker cone 58 or a diaphragm 68 to spider 72 connection element 74. In each pictured radiator, a central moveable element is suspended by a speaker "surround" (52, 70, 84) which acts as the flexible element between the stationary front of the speaker basket (50, 66, 80) and the speaker moveable element. Because the range of travel available from each spider (62, 72, 88) is less than the range of travel available from the surround (52, 70, 84), as the spider (62, 72, 88) reaches the limit of its travel and stops. The sudden stop in the movement of the spider due to its full extensions causes distortions in adjacent components as well as in the pressure gradients in the speaker chamber. These distortions can be heard as static and/or unnatural discontinuities in the sound. The ratio of the speaker basket back opening "B" (which supports the spider) to the speaker basket front opening "A" (which supports the surround) is approximately 0.5 (or 50%).

In the instance when a passive radiator constructed solely of a speaker cone is connected only as its peripheral rim to a annular support surface in the wall of a speaker, for example, as shown in the Klasco, U.S. Pat. No. 4,207,963, a larger range of travel is available to accommodate large movable element displacements experienced at high volumes at low frequencies. However, the use of a surround around the perimeter of the top of the cone and the cone shape produces cone wobble which also distorts the sound. The object of the Klasco patent was to arrange active elements to reduce the wobble in the passive radiator.

In the instance where a lone speaker cone suspended in a cavity opening is used, the response of the passive radiator during low frequency cycles as the cone is forced outward and pulled inward can be non-linear as the flexible member (surround) holding the cone tends to have different non-linear force to displacement characteristics when being stretched outwardly as compared to when it is being stretched inwardly.

The limitations on travel as shown in the prior art described in FIGS. 4, 5 and 6 and the wobble of a passive radiator as discussed in the Klasco patent and such a configuration's non-linearity, highlight the shortcomings of the prior art passive radiators.

The spatial requirement of the prior art passive radiators is also a drawback. The prior art passive radiators are quite large and bulky and extend a large distance into any sealed cavity. This spatial requirement must be taken into account when designing features and companion speakers to fit into the sealed cavity.

SUMMARY OF THE INVENTION

An embodiment according to the invention overcomes the drawbacks of the prior art by providing a generally linear response by configuring two speaker surrounds opposite one another so that any non-linearities in the spring constant between an outward displacements versus an inward displacement are generally cancelled and a pseudo linear spring constant is developed throughout the central range of travel of the passive radiator moveable elements.

In an embodiment according to the invention an inner surround encircles and has an inner edge fixed to the perimeter of an inner center member which is generally a flat disk and may be a flat disk diaphragm. The arch of the surround between the inner edge and the perimeter edge of the inner surround extends in a first direction. An outer surround encircling and having an inner edge fixed to the perimeter of an outer center member is configured so that its arch extends in a second direction which is opposite the first direction. A connection member or mass is fixed to and between the inner center members and the outer center member causes the two to move together and in parallel. The connection member may be a specially sized mass to tune the passive radiator for resonance at a particular frequency.

Variations of embodiments according to the invention include using a ratio of the size of the inner center member to the outer center member or outer center member to the inner center member of between 0.8 and 1, the calculation of the ratio will be such that the ratio will always be 1 or less. Another embodiment provides the inner central member and outer central member to be connected and integral as one piece with an annular spring (elastic) member between the central integral inner and outer member core and the surrounding speaker frame opening. A cut out section of the wall of the speaker cabinet, for example cain form the central diaphragm core, and the application of an elastic flowable substance that can be formed in place to form an elastic bond between the core and the surrounding support frame (usually a hole in the speaker cabinet) by using a formable elastic substance that can be formed in to a desired shape in flowable gel or liquid type state. Where the flowable substance sets up to have acceptable elastic qualities such as might be found when using a spider or surround of the current design in that location.

A further aspect of the invention involves structures and methods which enhance embodiments according to the invention by eliminating high pressure air between surround rolls during long strokes of the passive element by providing an air vent system. This system prevents creation of a high-pressure secondary air cabinet that slows the response.

A still further aspect of the invention relates to the utilization of multiply configured concentric surrounds in a long stroke passive speaker configuration to provide a high quality sound without noticeable group delay while still providing high SPL (sound pressure levels). A progressive roll passive system utilizes progressively smaller surround roll diameters to achieve high sound pressure levels with minimal distortion with a short overall height.

BRIEF DESCRIPTION OF THE DRAWINGS

FIG. 25 shows plots of surround extension versus force for several configurations (as shown in FIGS. 25A, 25B and 25C) of large displacement passive radiators to show a comparison of generalized behavior when the progressive roll embodiment of the present design is compared with several alternatives;

DETAILED DESCRIPTION

Figure 7:
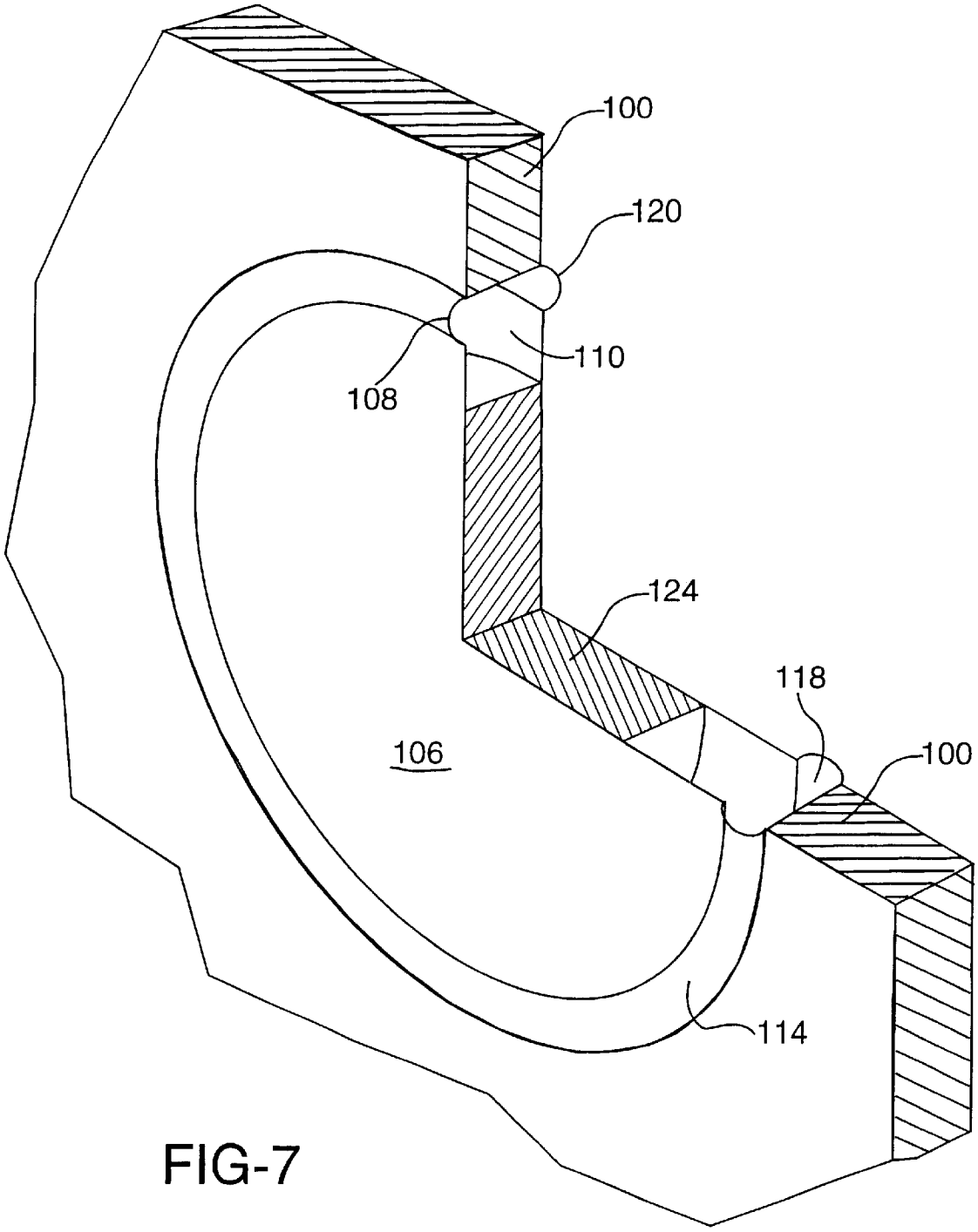
FIG. 7 shows an isometric cut away view of a configuration according to the invention.
Figure 8:
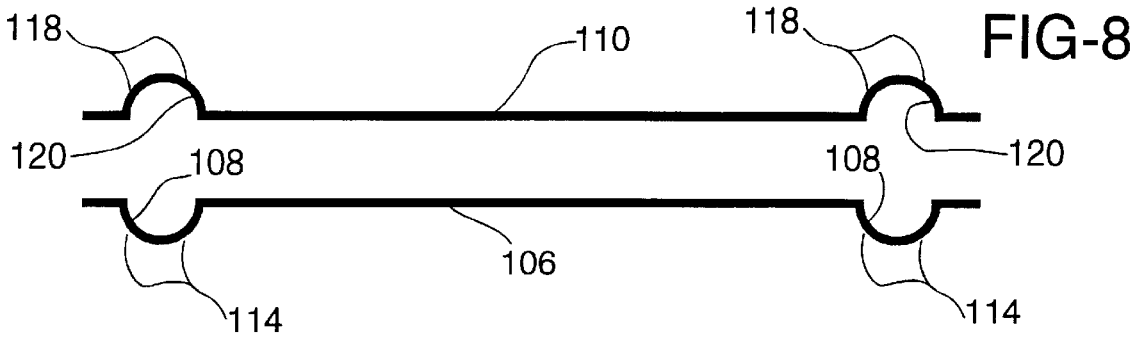
FIG. 8 shows a cross-sectional view of a diaphragm plate fixed to a surround which in turn is fixed to an external ring. Prior to their assembly into a configuration according to the present invention.

An embodiment according to the invention is shown is FIG. 7. A speaker box which acts as an integral speaker support ring 100 is a circular opening in a speaker box. To the speaker box at one edge of its wall is attached an inner surround 114 which has at its inner perimeter an inner diaphragm 106. At the outer wall of the speaker box 100, an outer surround 118 is attached with its inner perimeter fixed to an outer diaphragm 110. A connecting member (or mass) 124 is fixed between the two diaphragm 106, 110 so that the two move together in parallel as the sound pressure due to the frequencies in the sealed box causes the displacement of the two diaphragms simultaneous and in parallel. The inner and outer surrounds 114, 118 are configured so that the arch of 108 of the inner surround projects inwardly while the arch 120 of the outer surround 118 projects outwardly. In short, the center diaphragms 106, 110 and connection member 124 are supported only by the surrounds 114, 118 and the arches 108, 120 of the surrounds project in opposite directions.

In a normal speaker configuration where only one surround is used, e.g., at the perimeter of a speaker cone, there is a non-linear characteristic in the restoring force relative to displacement for a normal half circle type surround. The restoring force is the force that restores the speaker assembly to its neutral position for example during transportation and/or when the speaker is not in use. The non-linearity of the stressing of the inside surface of the arch versus the outside surface of the arch as the surround is stretch by the displacement of a center disk or speaker cone creates a small but detectable distortion. In such arrangements increased air pressure due to the sound waves does not move the diaphragm at the same rate when subject to similar pressure gradients, but rather the air starts to become compressed and generate reflected pulses as a result of the non-movement or slower movement of the diaphragm due to the different displacement rates. As the diaphragm in the passive radiator is exposed to air pressure due to sound volume, the use of two oppositely facing surrounds provide an effective compromise and an improvement over the use of the single surround by providing an approximately linear pressure to displacement relationship irrespective of whether a sound wave is positive (for example, causing the diaphragm to move out) or negative (for example, causing the diaphragm to move inward).

Figure 10:
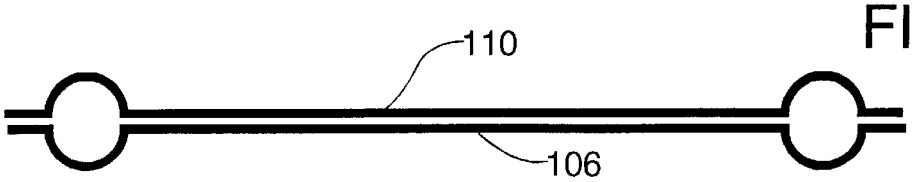
FIG. 10 shows a configuration according to the invention where the two diaphragm plates are fixed one to the other.
Figure 11:
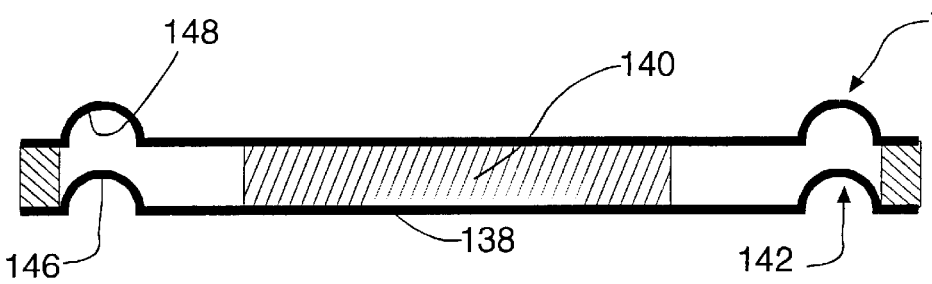
FIG. 11 shows an alternate configuration according to the invention where the arches of the speaker surround project in the same direction.

The use of two oppositely facing surrounds which are fixed to each other and with virtually no separation, for example, as shown in FIG. 10 provide a benefit over the prior art in that the spring constant in the full range of travel from the extreme negative through the neutral (or balanced condition) position to the extreme positive is much closer to linear than when using a single surround alone. However, in the configuration of FIG. 10, wobbling (defined as non-uniform displacement of the diaphragm) of the surround around its perimeter, for example, if a sound pressure wave were to come not perpendicularly into the diaphragm but at an acute angle from one side, then one side of the diaphragm could be preferentially displaced more than the other side at least monetarily this wobble could cause an undesired reflective wave and sound interference which is out of phase with the primary frequency. However, in instances where such a passive radiator is mounted directly opposite a single driver or a group of generally symmetrically arranged drivers, e.g., as in the Klasco patent discussed above, the configuration of FIG. 10 provides a noticeable if not distinct advantage over configurations where only a single surround using a speaker cone is used. Further, the flat surface of the diaphragm provides no transverse surface against which a transverse component of a pressure wave vector could cause lateral translation of the diaphragm as it could in a the prior art where the speaker cone provides a substantial laterally extending surface, which accentuates the any wobble that is experienced.

Figure 9:
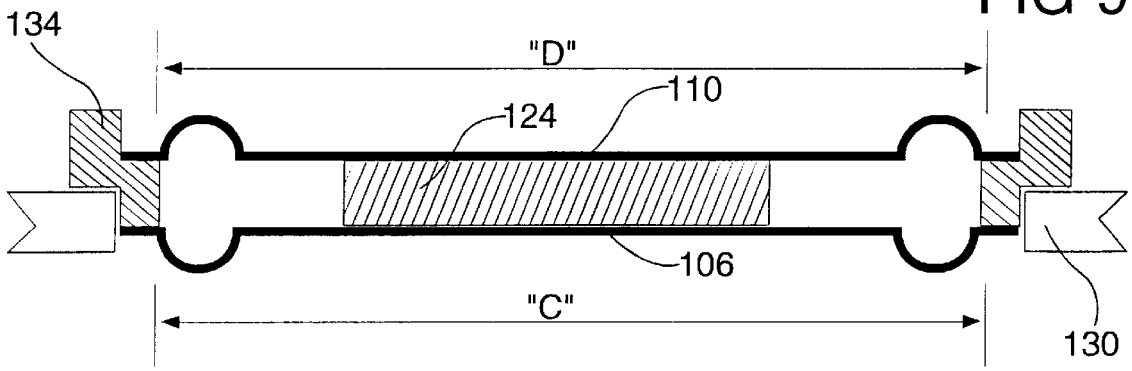
FIG. 9 shows a configuration according to the present invention fixed in a speaker wall.

A configuration according to the present invention has the additional advantage of eliminating the wobble problem by the use of a parallelogram-type parallel link arrangement where the two diaphragms 106, 110 each have their perimeters act as two ends of a fixed link of a parallelogram type linkage. A second set of fixed links are the corresponding inner and outer walls to which the outside perimeter of the surrounds 114, 118 are fixed. The moveable links connecting the two fixed links are the surrounds which extend between the perimeter of the central diaphragm 106, 110 and the inner perimeter of the outer ring for example, 134 in FIG. 9. Using this configuration will reduce any wobble by creating additional resistance to a wobbling effect due to the two surrounds being mounted in parallel at the end of what effectively amounts to an elastically extendible pivoting lever arm. Thus any configuration according to the invention for example as shown in FIG. 9, where a 45 degree sound wave coming into the central diaphragm would be resisted by both sets of surrounds such that predominately linear motion perpendicular to the face of the diaphragms would occur. The motion of the central diaphragm assembly while not completely limited to a linear back and forth motions is severely constrained to move easily only back and forth perpendicular to the diaphragms 106, 110 absent a strong transverse force vector. Similarly, the flat face of the diaphragm rigidly resists pressure pulses having force vectors which are parallel to its face, while it is very easily movable in a direction perpendicular to its face when impacted by sound pulses having force vectors with directional components perpendicular to the face of the diaphragm. In this way, an improved passive radiator can be constructed and used. While in the Figures shown, the ratio of the inner and outer diaphragm support openings are substantially equal, (i.e., they have a ratio of approximately 1), it is possible to construct passive radiators according to the invention where the ratio of the smaller diaphragm connection opening to the larger diaphragm connection opening is approximately 0.8 or greater (e.g., distance "C" on one side of the opening will be different than the distance "D" by a ratio of the smaller to the larger of 0.8).

The construction of the passive radiator is quite simple as shown in FIGS. 7, 8, 9, 10 and 11. The outside edge of the surrounds can be fixed directly to a sealed cavity or can be fixed to a surround support ring 134 which in turn is then fixed to a speaker enclosure wall 130. Some combination of elements to hold the outer ring and allow the center to move freely from its neutral position must be found.

An alternative configuration using a series of surrounds 142, 144 provides that the arches of 146. 148 such surround must extend in a single direction. This configuration while not optimum does provide the advantage over the prior art of eliminating or substantially eliminating the wobble problem referred to earlier. In a configuration as shown, the spring constants will be unequal and the non-linearity of the spring constant plot will be attenuated by the use of two surrounds whose spring constants add to exacerbate their distortion from linear.

Figure 12:
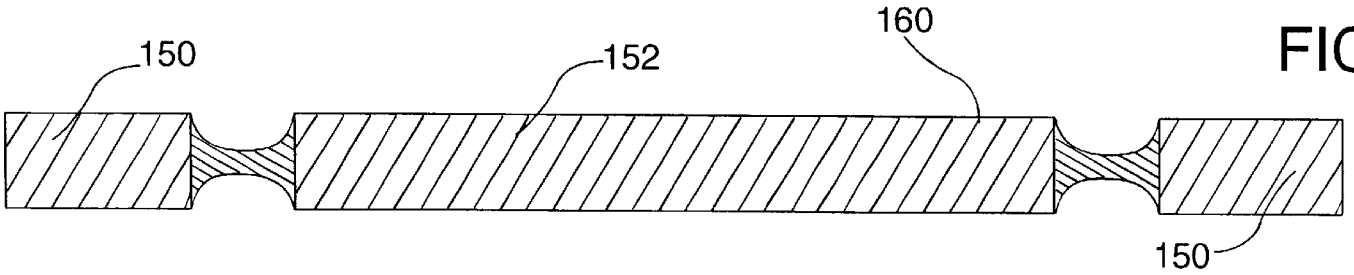
FIGS. 12, 13, and 14 show cross sectional views of several alternate embodiments according to the invention, where the wall of the speaker cabinet is used as the flat central core member of the passive radiator in a speaker system.

FIG. 12 shows an alternate embodiment according to the invention, a speaker cabinet wall 150, initially one piece, has circular slot routed into it thus separating a centerpiece 152 from the speaker cabinet wall 150. The round centerpiece 152 is centered in the opening of the cabinet wall and a wide contoured bead of filler material (e.g., silicon rubber) is run between the inside of the outer opening of the wall and the outside of the centerpiece 152. The cross sectional shape of the filler material is such that it retains an elastic character once cured. The cross section shown is commonly found in elastic seals between building joints where substantial movement is expected.

Figure 13:
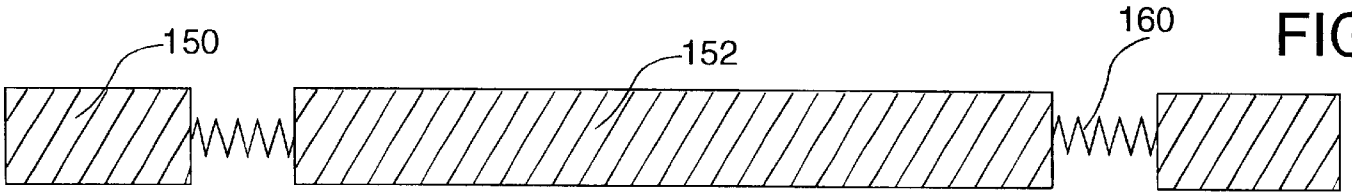

FIG. 13 pictures a spider type elastic member 160 having been placed between the centerpiece 152 and the speaker cabinet wall 150, as described for FIG. 12 above.

Figure 14:
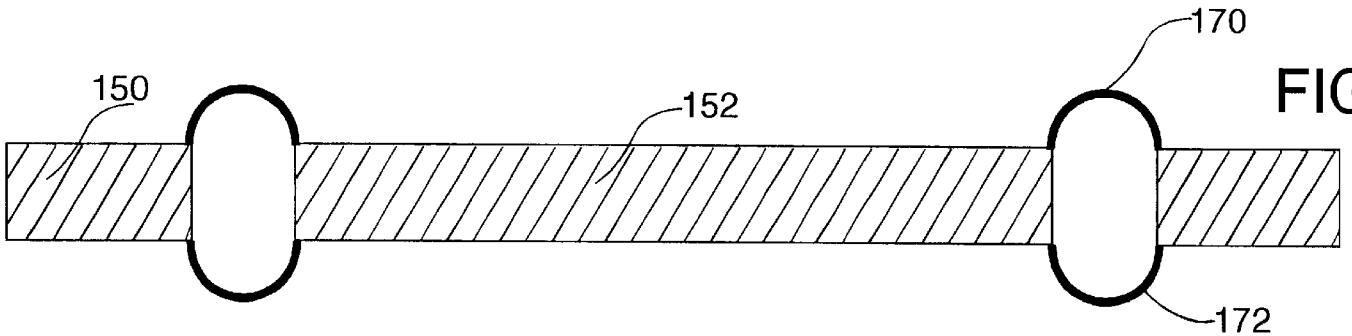

FIG. 14 pictures an alternate embodiment where a set of two surrounds 170, 172, provide the elastic connection between the speaker cabinet wall 150 and the centerpiece 152. While a round shape is preferred, the use of a less efficient shape is in accordance with the invention, for example a polygon or a compound curve shape may be used. A centerpiece thickness in excess of 0.25 inches is preferable to help maintain a linear movement and reduce or eliminate any wobble that may occur.

Figure 1:
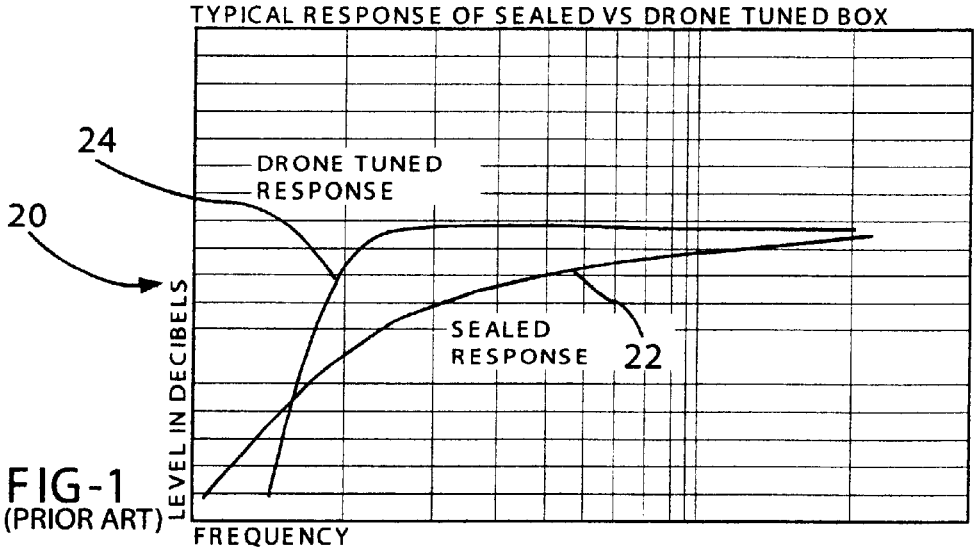
FIG-1 (PRIOR ART)
FIG. 1 is a plot of frequency response versus sound level in decibels showing the response of a sealed speaker box and a conventional droned tuned speaker box.
Figure 2:
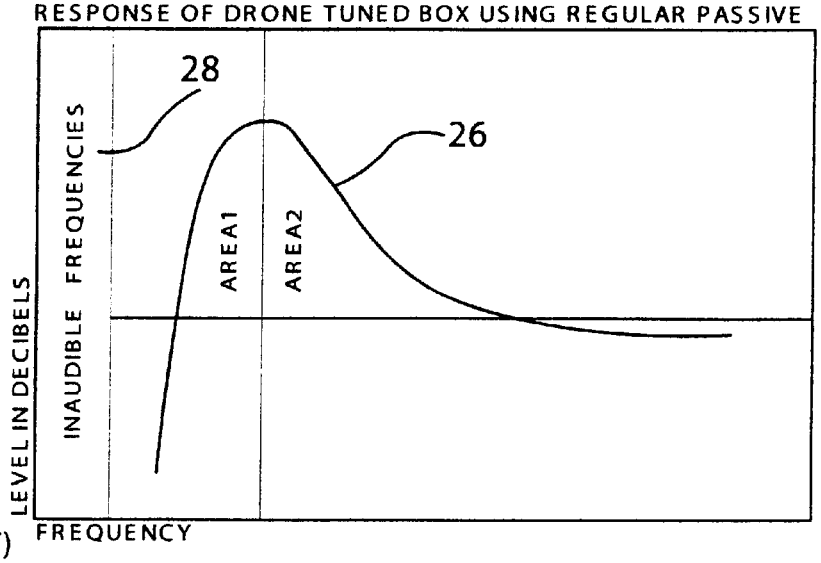
FIG-2 (PRIOR ART)
FIG. 2 is a frequency response graft showing the plot of the frequency response contribution from a passive radiator to the total tuned response in a speaker box system.
Figure 3:
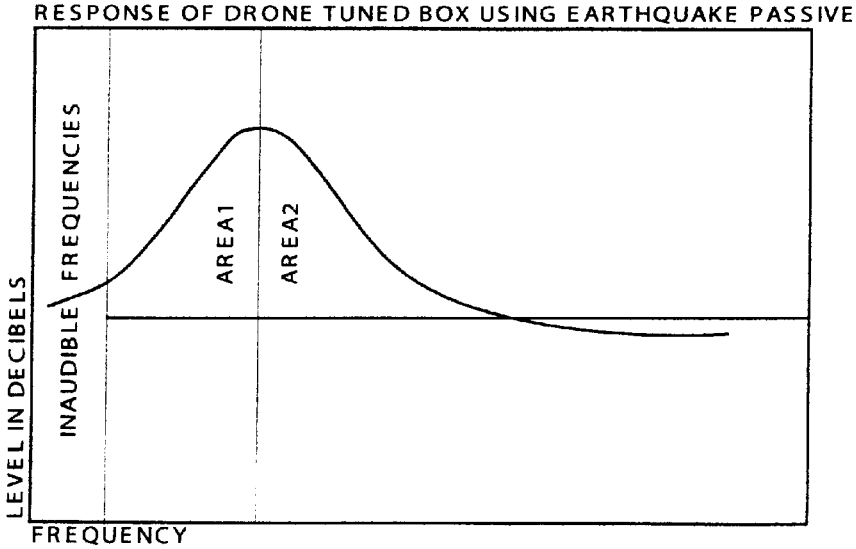
FIG. 3 is a frequency curve showing a plot of the frequency response using a device according to the present invention.

A review of the plot as shown in FIG. 3 shows that the frequency response of a tuned passive radiator according to the invention extends the usable frequency range from the low audible to the inaudible range of frequencies. All audible frequencies can be heard and the inaudible frequencies for example, an earth shake or pounding can be generated by such speakers so that the user can "feel" the vibration as the user's surroundings susceptible to such low frequency waves start to vibrate. The use of such speaker enhancing device is very attractive to sophisticated users as well as the general public in viewing many action movies that feature such low frequency sounds.

An aspect of the present invention further enhances the sound performance. The closure of spaces between opposing surround rolls can cause a high pressure secondary cabinet that slows down the response. A pressure relief system is provided to allow the air trapped between two diaphragms to have the same pressure as that in the speaker box (or alternately outside the speaker box) via port holes that are large enough to keep the air speed through these holes under 1% of the speed of sound with a value of about 12 ft/second. Since these numbers are worse at the passive resonance frequency, this calculation can be optimized for the maximum excursion calculation. The pressure relief port can be implemented best through holes in the inner surround that leak air directly into the speaker box.

Figure 15:
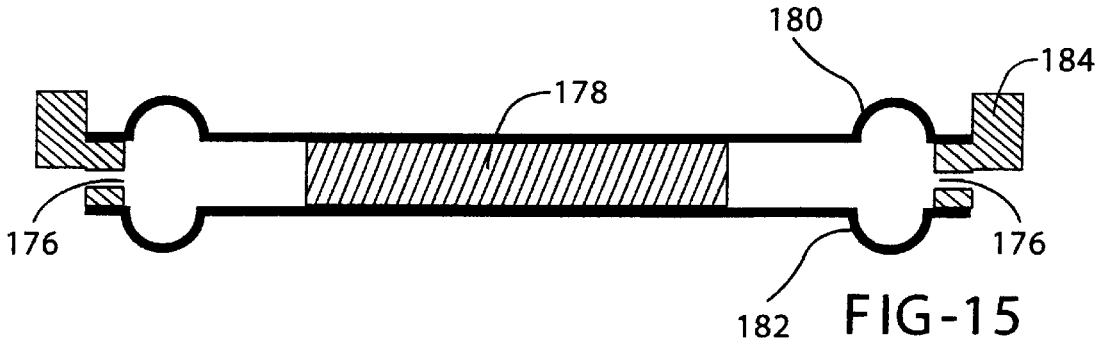
FIGS. 15, 16, and 17 show a schematic cross sectional configuration where the embodiment of FIG. 9 has been modified and configured with features which enhance in several different ways the passive speaker design.
Figure 16:
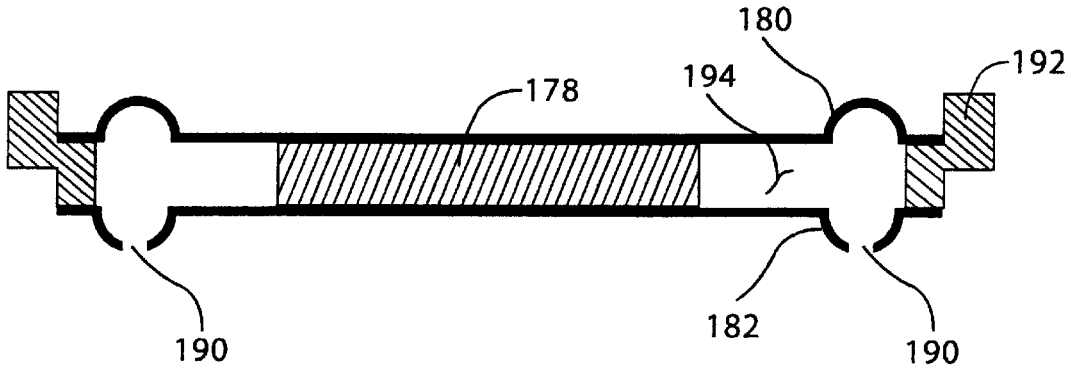
Figure 17:
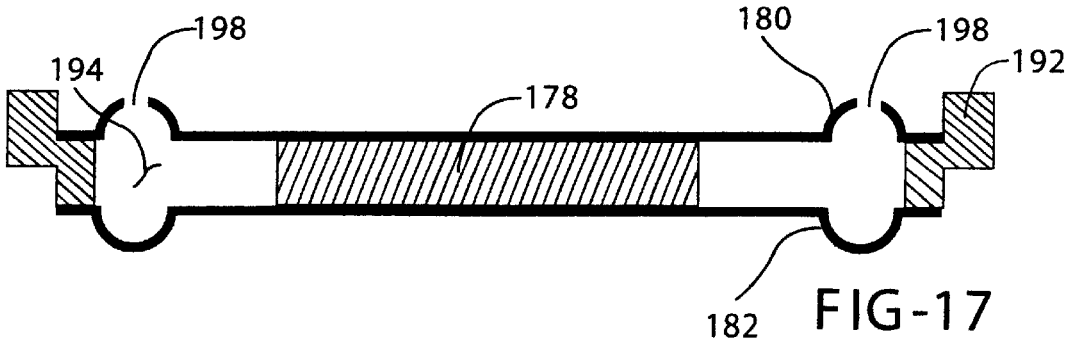
Figure 18:
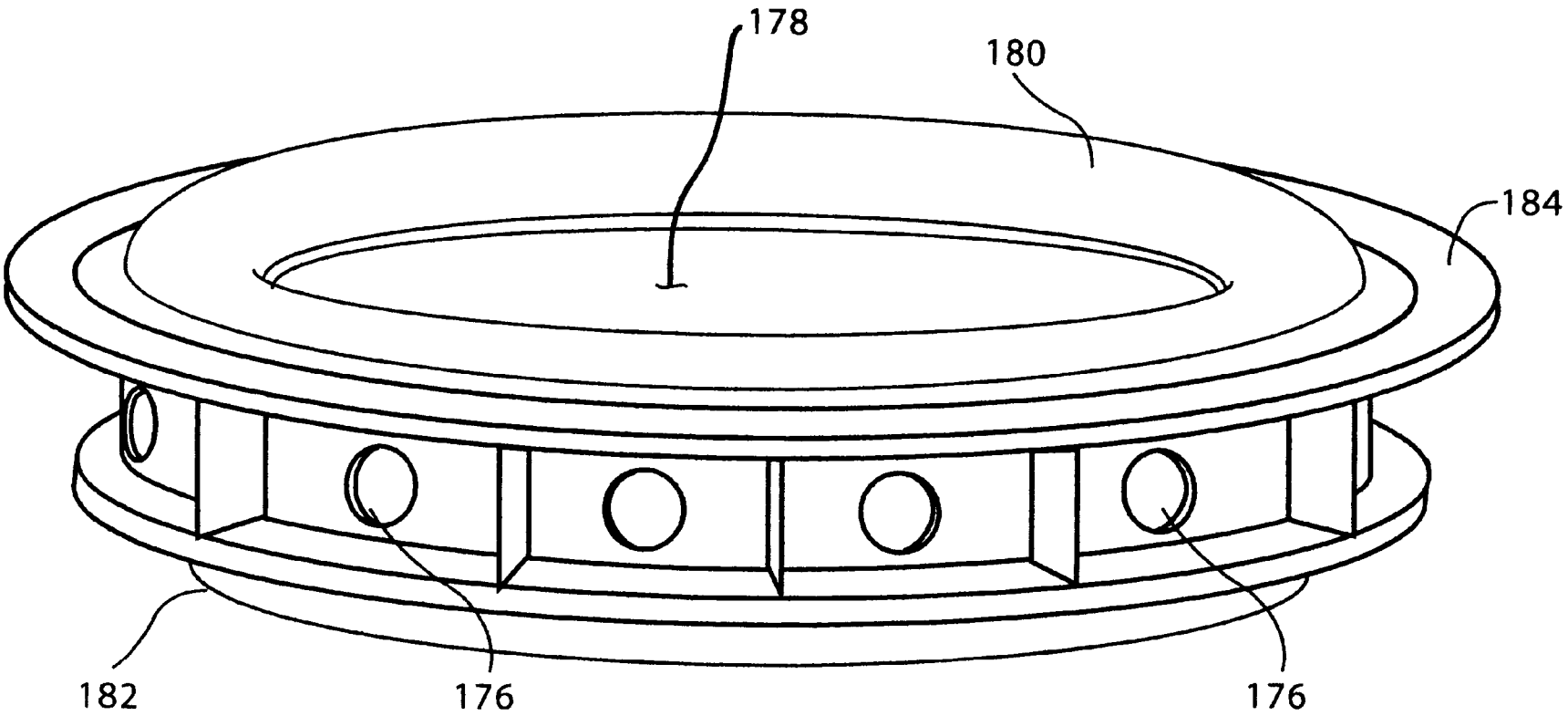
FIG. 18 shows a perspective view of a passive speaker according to the invention incorporating frame vent holes as one aspect of the invention.

FIGS. 15, 16, and 17 show several ways that an air vent (pressure relief system) according to the invention can be implemented. FIG. 15 shows in cross section vent holes 176 disposed to provide one or more passages from the air space between the center mass 178, the outer elastic member (surround) 180, the inner elastic member (surround) 182, and the outside frame 184, which can form a pressurizable chamber, through the frame 184. These same holes 176 are shown in the perspective view of FIG. 18 and again in the cross sectional perspective view of FIG. 19. In the schematic views in particular, it appears that the holes 176, in use, are situated to be nearly sealed against the surrounding wall hole opening of the speaker box in which the passive radiator might be mounted. To operate without noise the and undue damping there must be a space between the hole of the speaker box in which such a configuration is mounted and the perimeter of the radiator frame 184 facing it, so that air can pass freely at speeds below 2% of the speed of sound.

FIG. 16 shows a schematic cross sectional view of an alternate configuration for maintaining parallelism as the center mass moves back and forth due to speaker box pressures while still providing for improved response and large travel due to a pressure extremes. A series of holes (or slits) 190 are disposed approximately equally spaced around the annular ring of the inside surround 182. The holes 190 in this configuration are open to the inside of a speaker box and act as a vent to prevent the buildup of pressure in the surround contained air space 194. In the this configuration an outside frame flange 192 is solid.

Figure 20:
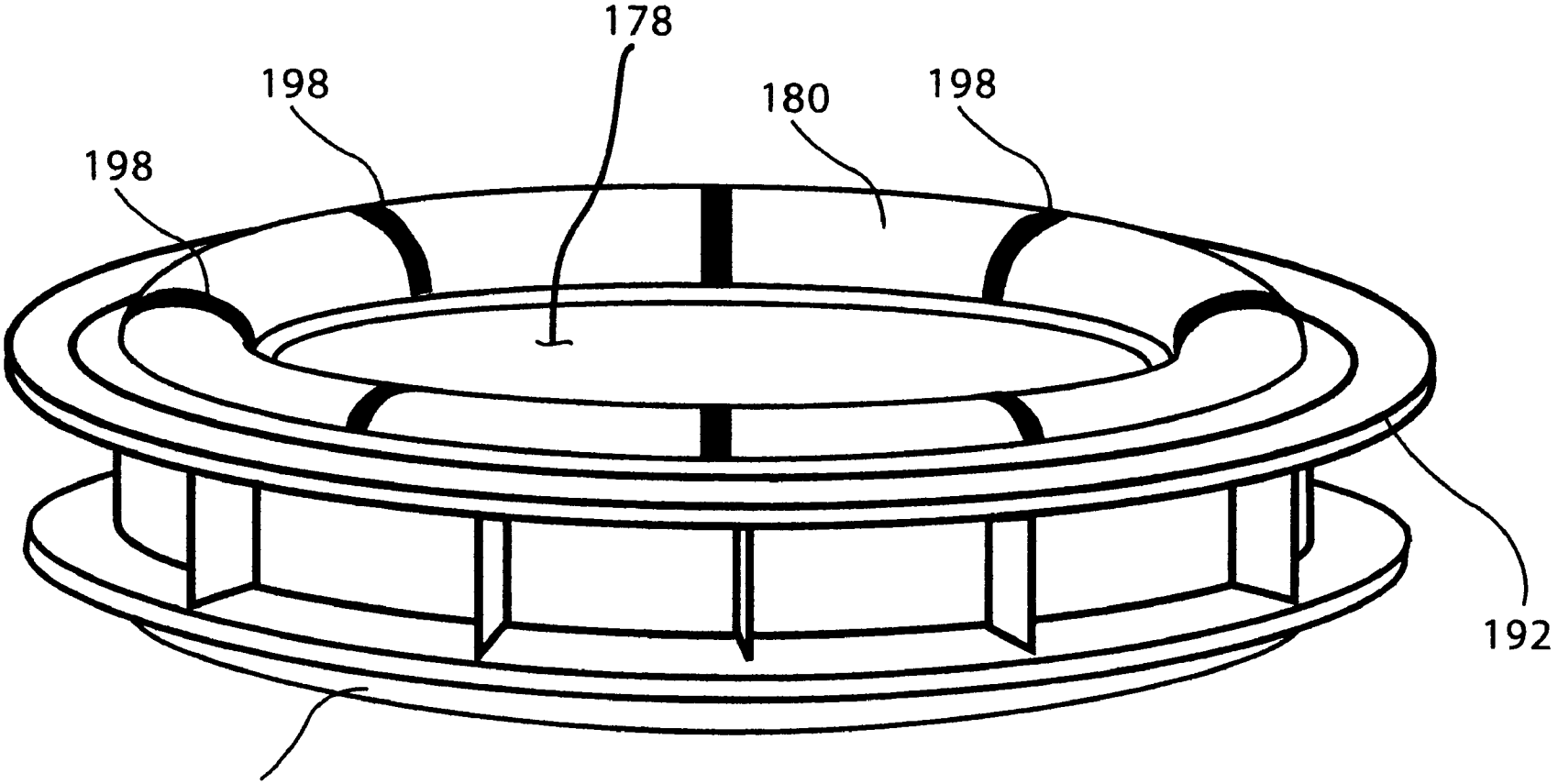
FIG. 20 shows a perspective view of a passive speaker according to the invention incorporating surround openings (slits) as vent holes as one aspect of the invention.
Figure 21:
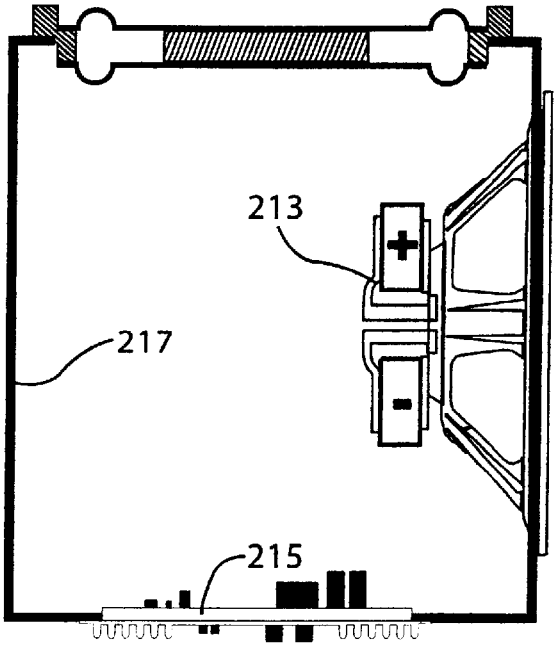
FIG. 21 shows a schematic cross sectional view of a speaker box utilizing a passive speaker design according the invention.
Figure 22:
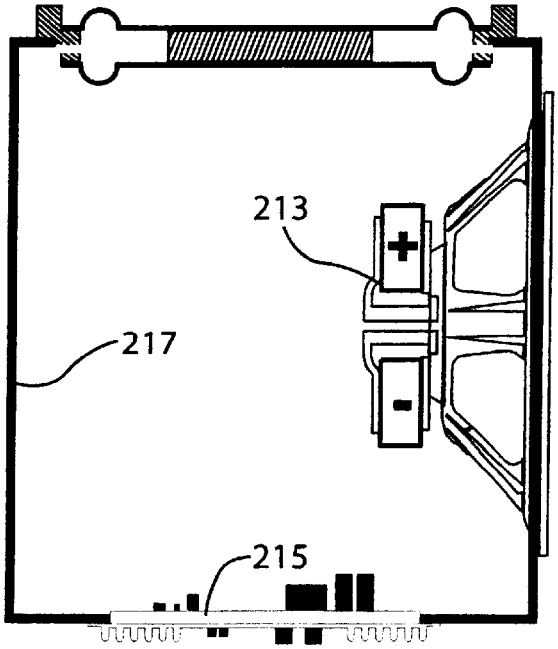
FIG. 22 shows a schematic cross sectional view of a speaker box utilizing a passive speaker with through the frame vent holes in a design according the invention.
Figure 23:
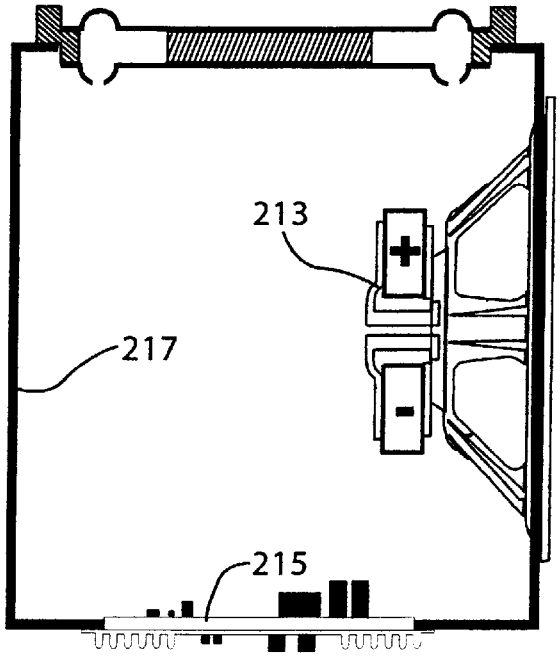
FIG. 23 shows a schematic cross sectional view of a speaker box utilizing a passive speaker with through the surround vent holes communicating with the inside of the speaker box enclosure in a design according the invention.
Figure 24:
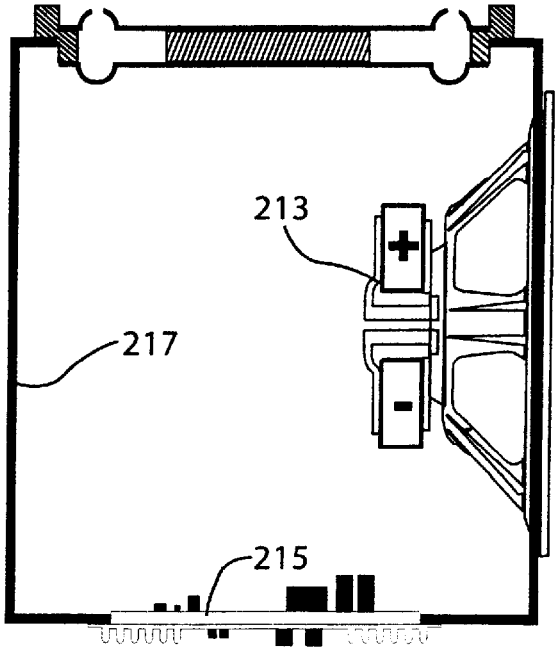
FIG. 24 shows a schematic cross sectional view of a speaker box utilizing a passive speaker with through the surround vent holes communicating with the outside of the speaker box enclosure in a design according the invention.

FIG. 17 shows a schematic cross sectional view similar to the configuration shown in FIG. 16. In this embodiment there are a series of holes (or slits) 198 which are disposed approximately equally spaced around the annular ring of the outside surround 180. The configuration of these hole 198 is also shown in FIG. 20, which shows a perspective view of this configuration. The holes 198 in this configuration are open to the outside of a speaker box and act as a vent to prevent the buildup of pressure in the surround contained air space 198.

Figure 19:
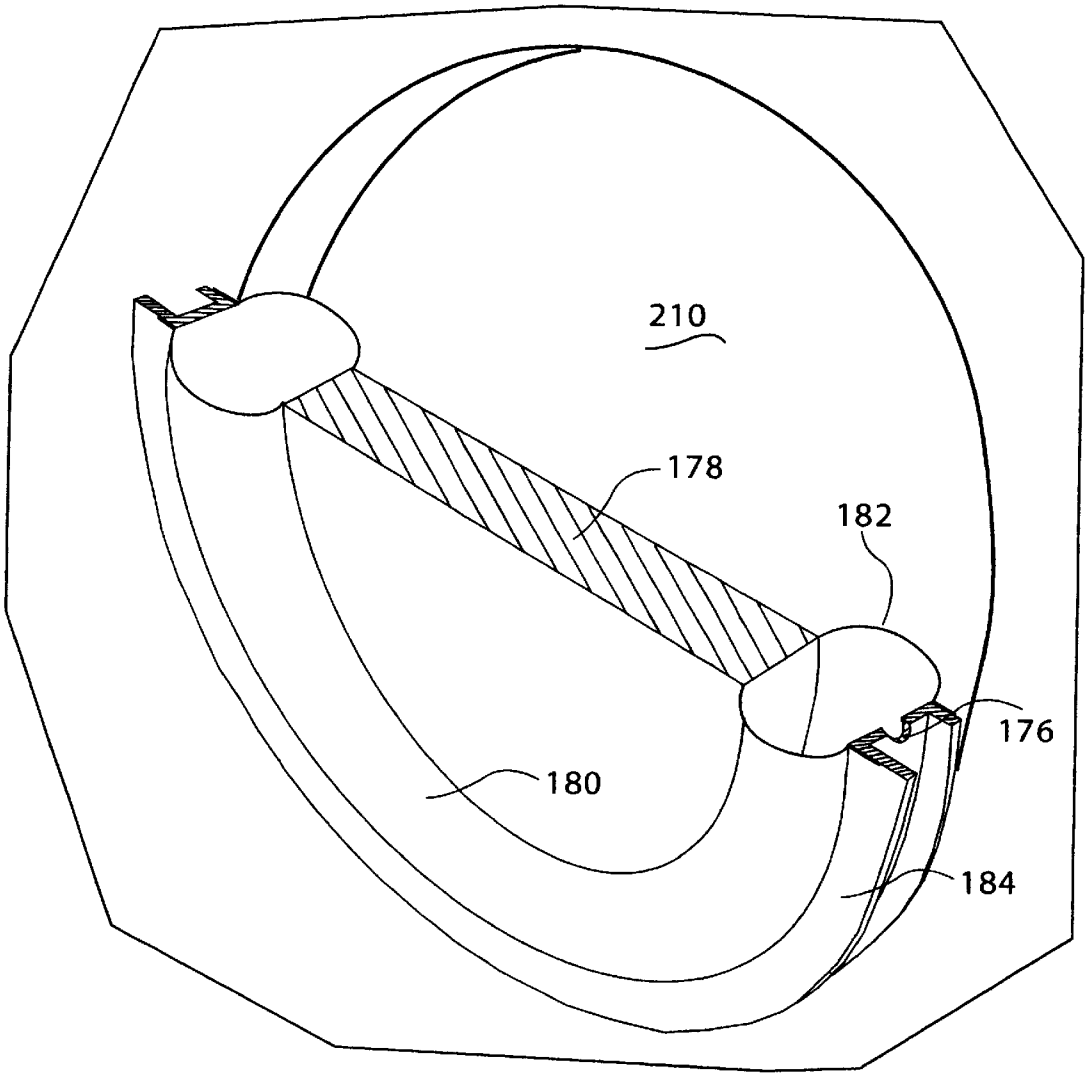
FIG. 19 shows a cross sectional perspective view of a frame side vent holed configuration as shown in FIG. 18.

FIG. 19 shows the passive radiator relationship to its mounting to a speaker box opening 210. In this configuration the outside frame 184 has two flanges, one smaller in diameter (which fits into the speaker box opening 210) and a second one that is larger in diameter that seals to the surface around the speaker box opening.

FIGS. 21, 22, 23, and 24 show arrangements of a speaker (high pressure box) box containing a driver (speaker) 213 and an amplifier frame with amplifier circuitry 215 fixed to the speaker box 217 (in these instances the frame is sealed to an opening of said speaker box u with heat sink elements of the amplifier outside the box). Each of these speaker boxes includes an opening for receiving a passive radiator according to the invention. Passive radiators as shown and described in FIGS. 9, 15, 16, and 17 are shown positioned in the passive radiator opening of the speaker box as pictured in FIGS. 21, 22, 23, and 24, respectively.

Progressive Surround Roll Radiator Construction

An aspect of the present invention that utilizes low profile large stroke passive radiators includes the use of a progressive roll system that further enhances the performance of passive radiator design.

Low frequency instruments emanate sound waves via vibration of diaphragms. These diaphragms oscillate at a low frequency. The oscillations have maximum amplitude in the center of the diaphragm with a proportionally reduced oscillation across the diaphragm with no oscillatory motion at the diaphragm frame. The dynamic oscillatory activity associated with a bass drum is useful in illustrating the dynamic relationship between the oscillating diaphragm and the emanating sound wave.

When a drummer strikes the center of the bass drum, the striking force bends the diaphragm inward such that the diaphragm shape is no longer flat, but is deformed is an approximation of a cone or sphere. The pressure inside the drum increases and is transferred to the other side of the drum, and results in an outward movement of the diaphragm. The tension and the phase angle of the sound wave as they bounce back and forth allow the signal to decay in a harmonic fashion. The decay time is directly related to the diaphragm diameter, tension and the distance between the two diaphragms at any fixed frequency. Utilizing the apparatus and methods according the invention provides that opportunity to approach a bass drum sound when using a relatively smaller 12" and 15" speakers. To approach the desired condition the passive matched with the speaker has to be tuned low enough and has to move out axially to produce the same air movement, i.e., SPL at any given frequency is strictly related to the quantity of air moved at that frequency. The quality of sound must also be maintained. The quality of sound is measured by the group delay. A group delay is the time versus frequency curve that describe the response time delay at any given frequency. A 20 ms delay at 20 Hz is said to be audible distortion. Group delay is directly proportional to the diaphragm excursion. A long excursion creates long group delays.

Figures 25A, 25B, 25C:
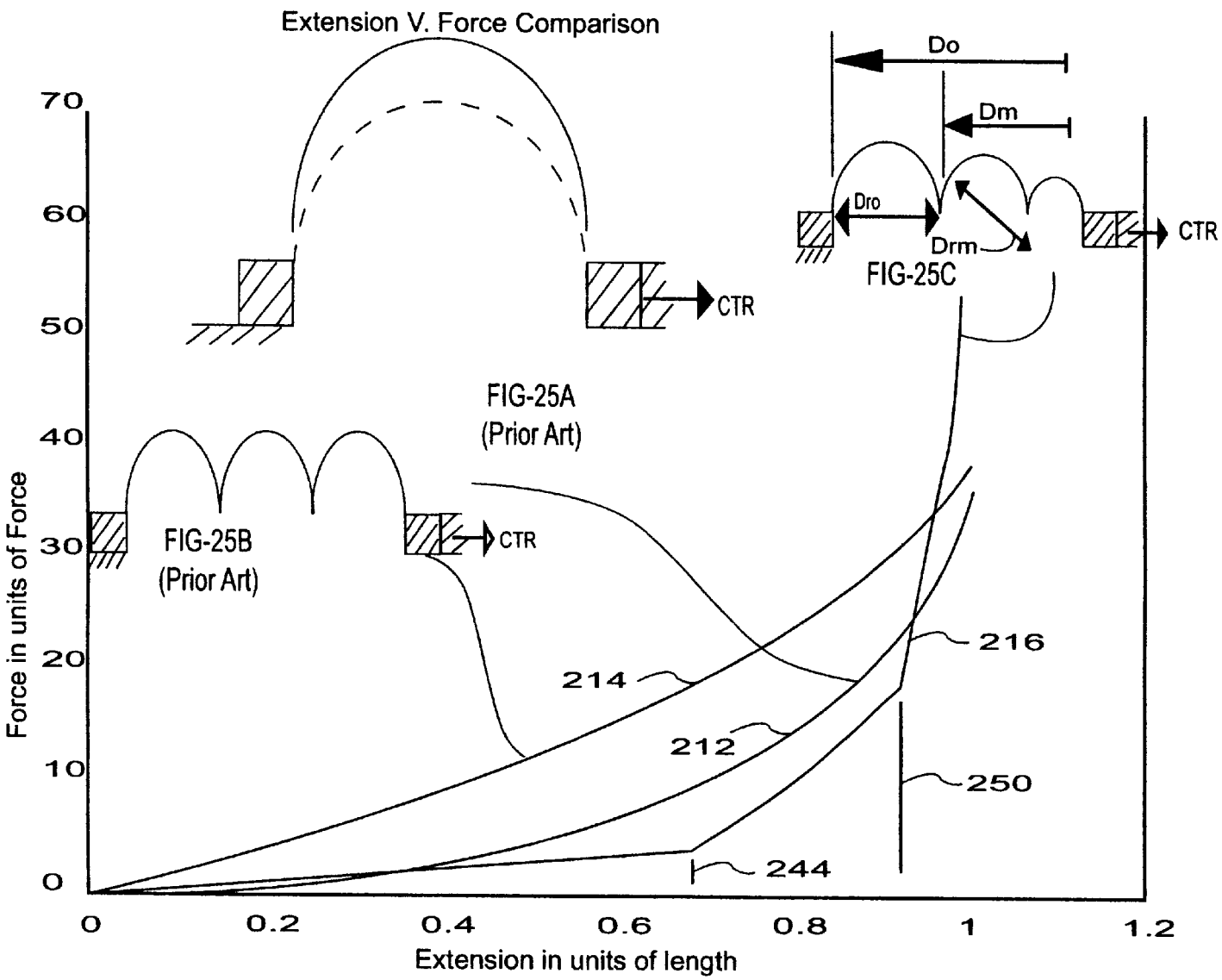
FIG-25A (Prior Art)
FIG-25B (Prior Art)
FIG. 25A shows a cross sectional view of one elastic membrane of a set of two which support a mass from a frame for a passive speaker, the design includes two example of using one large roll to span a large gap to provide a large stroke for the vibrating mass.
FIG. 25B shows a cross sectional view of one elastic membrane of a set of two which support a mass from a frame for a low profile passive speaker, the design includes three surround rolls having substantially equal roll diameter.
FIG. 25C shows a cross sectional view of one elastic membrane of a set of two which support a mass from a frame for a low profile passive speaker, the design includes three surround rolls utilizing progressively smaller surround roll diameters as the elastic membrane moves from the perimeter frame to the center mass.

One example of a surround structure used in speaker is to used a single large surround, a cross section of which is pictured in FIG. 25A. The single surround provides a large axial stroke and an even larger stroke if a an elliptical cross section (as shown by the solid line) as opposed to the circular cross section (as shown by the dashed line) is used. While this configuration has a good potential for large axial movements, the large roll diameter allows side to side instability at even small increments of axial excursion. A plot of relative excursion versus relative force for an approximation of an elliptical surround configuration is shown as curve 212 as pictured in FIG. 25. The restoring force is relatively small at small axial displacements (extensions) and rises rapidly as the extension increases.

Figure 4:
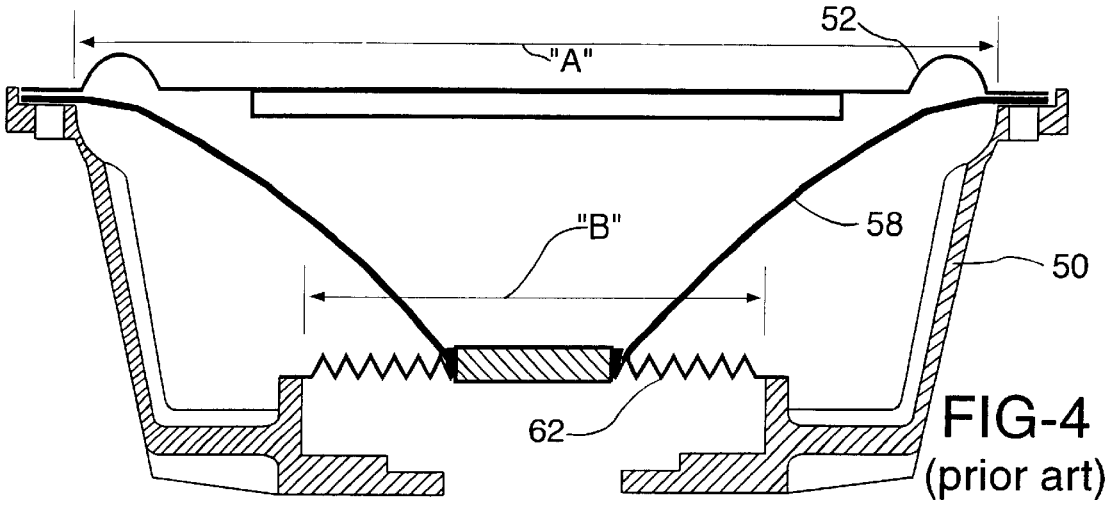
FIG-4 (prior art)
FIG. 4 is a cross sectional view of the prior art passive radiator supporting masses at both the base of the cone and on a diaphragm spanning the large opening of the cone at the base of the speaker.
Figure 5:
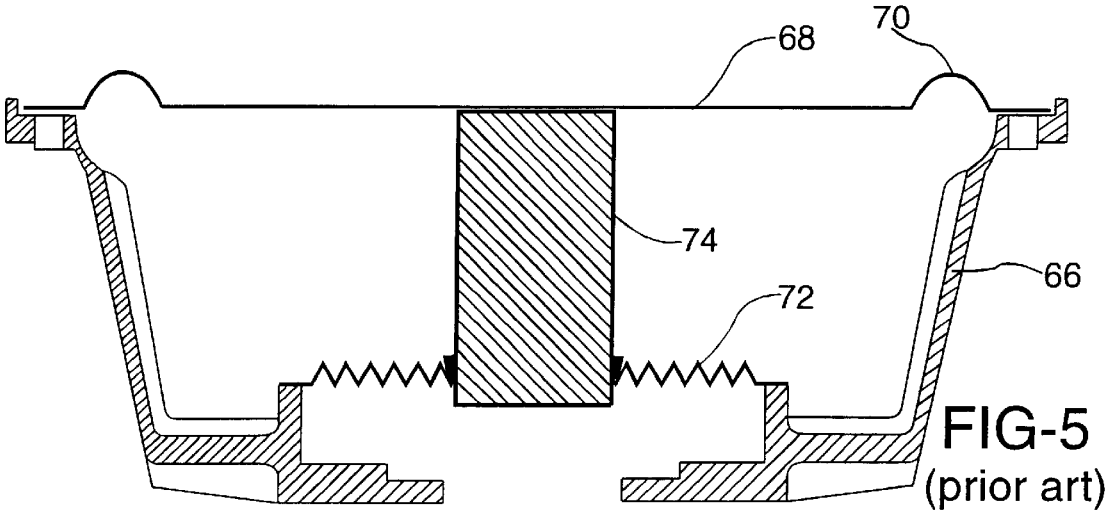
FIG-5 (prior art)
FIG. 5 is a cross-sectional view of a prior art passive radiator showing a moveable diaphragm connected to a speaker surround at the mouth of the speaker baskets to a speaker spider at the back of the speaker basket.
Figure 6:
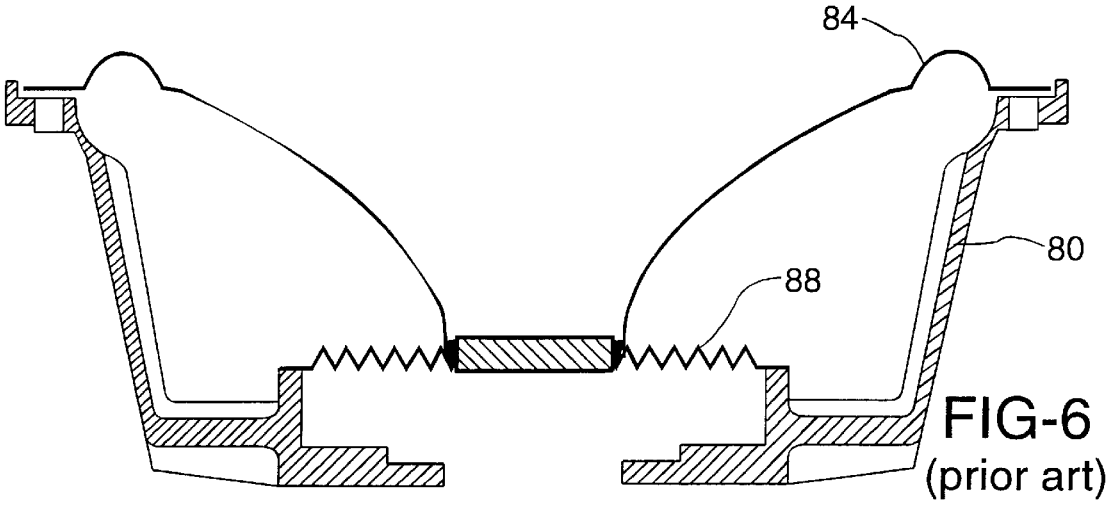
FIG-6 (prior art)
FIG. 6 shows a cross-section of a prior art passive radiator showing a speaker cone with a tuning mask at its base connected to the spider to the speaker basket at its narrow end connected through a surround to its wide end of the speaker basket.

A second example of a surround structure is the use of what are known as an "m" surround (two or more side by side surrounds). FIG. 25B shows such a structure where three smaller roll diameter surrounds are joined in a concentric circle pattern with the intent to achieve a large excursion—like the one shown for the single surround of FIG. 25A—with a lower profile. A plot of relative excursion versus relative force for an approximation of the three side by side surround arrangement is shown by the plot 214 shown in FIG. 4. The restoring force at low excursion (extension) dimensions is greater than that for a single elliptical surround as shown in FIG. 25A.

Figures 26A, 26B, 27A, 27B:
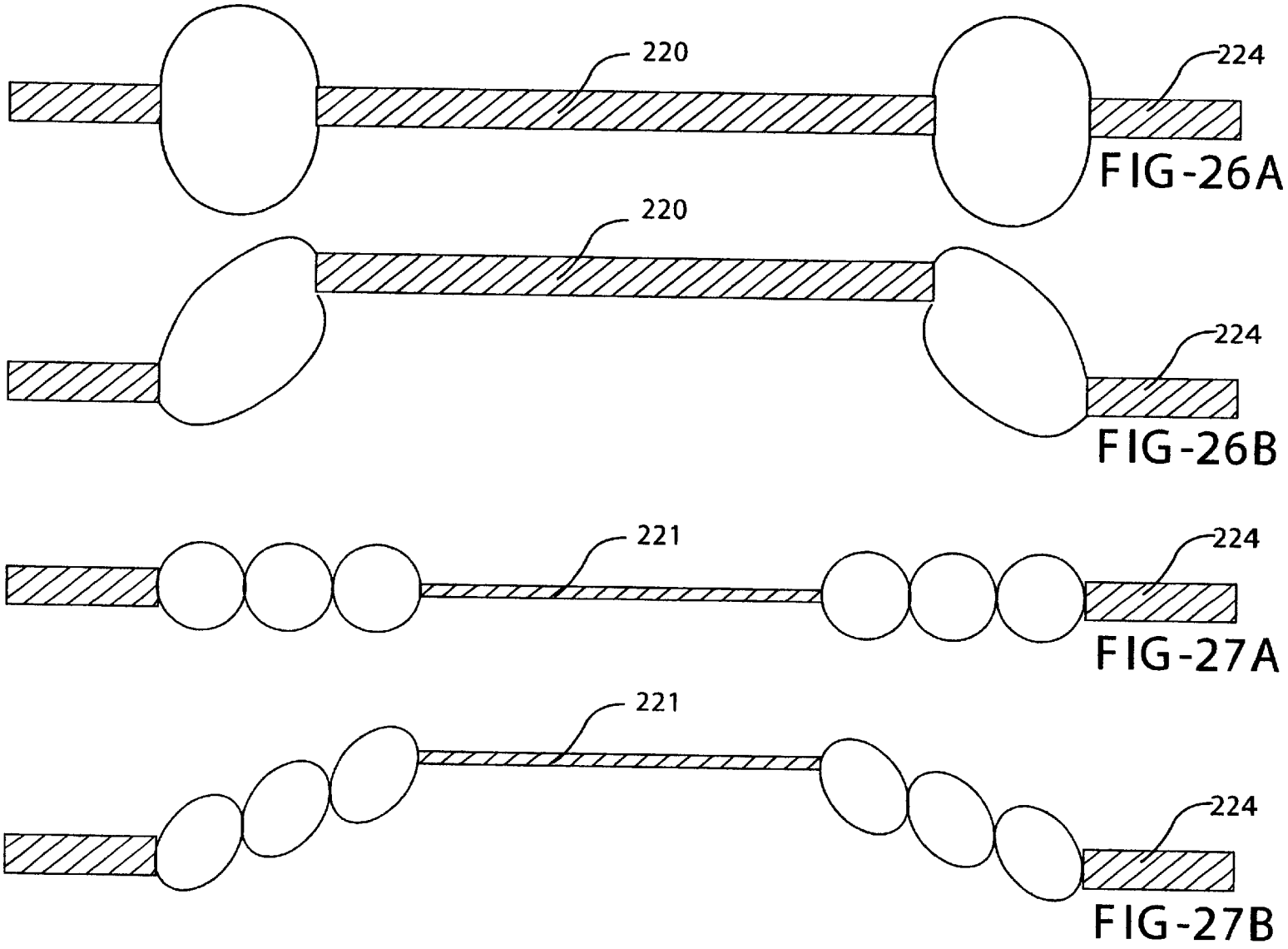
FIGS. 26A and 26B show cross sectional schematic views of the single surround large gap arrangement as shown in FIG. 25A, the relaxed state is shown in FIG. 26A and a nearly fully extended state is shown in FIG. 26B.
FIGS. 27A and 27B show cross sectional schematic views of the three equally sized roll diameter surround arrangement as shown in FIG. 25B, the relaxed state is shown in FIG. 27A and a nearly fully extended state is shown in FIG. 27B.

A set of cross sectional views of a passive speaker arrangement using a single the single large surround and the three small surrounds (of FIGS. 25A and 25B) in a relaxed state is shown in FIGS. 26A and 27A, respectively, and in their fully extended state in FIGS. 26B and 27B, respectively. What is noteworthy about reviewing these passive radiator arrangements is that while their relative force versus extension curves are relatively straightforward (though nonlinear) and similar, the excursion in the axial direction of motion is distributed substantially uniformly over the whole span of the gap between the centerpiece (220 or 221) and the outer frame 224. This uniform distribution of the strain (extension or excursion) correlates to a lateral (side to side) instability (wobble) of the centerpieces even at small excursions associated with small sound pressure levels. And any instability introduced at small excursions is amplified as the magnitude of the excursion increases.

To optimize an apparatus according to the present invention large qualities of air must be moved, but using the shortest most even diaphragm possible, like a bass drum. The diaphragm movement must decay uniformly at the side, i.e., as the diaphragm approaches the stationary frame. The movements must be axial and not side to side as such movements will cause a wobble that produces audible distortion.

Figures 28, 28A, 28B, 28C:
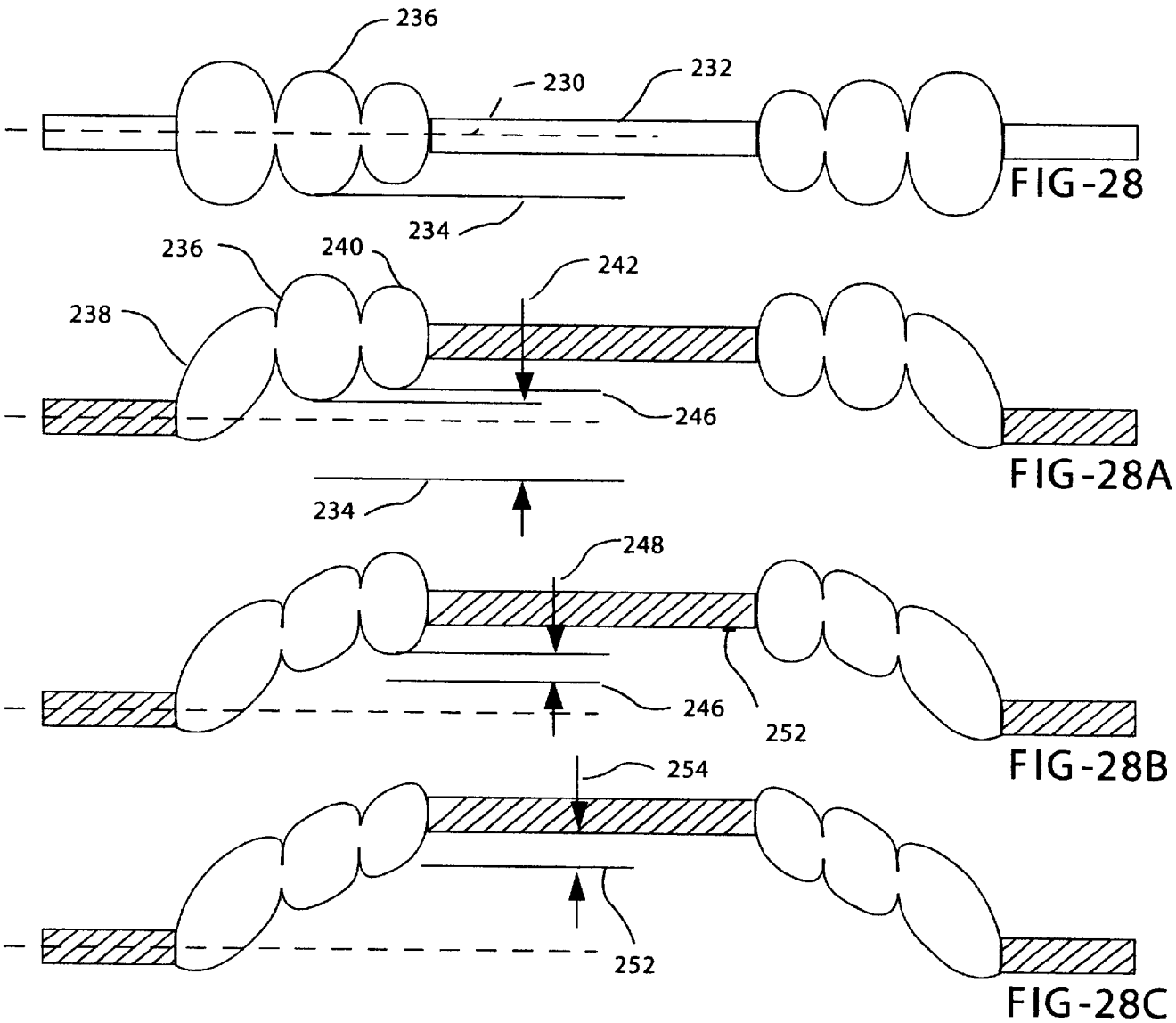
FIGS. 28, 28A, 28B and 28C show cross sectional schematic views of the three progressively sized roll diameter surround arrangement as shown in FIG. 25C and according to the invention, the relaxed state is shown in FIG. 28 and a nearly fully extended state is shown in FIG. 28C, a state where substantially only the outer surround roll is extended is shown in FIG. 28A, and a state where the outer surround roll and middle surround roll are substantially fully extended is shown in FIG. 28B.

A embodiment according to the invention which overcomes the drawbacks of the previously discussed arrangements, is to use a progressive roll diameter configuration, for example a cross section of which is shown in FIG. 25C. In this arrangement a set of three surrounds are provided the outer surround being the largest, with surrounds internal to the outer one being progressively smaller. This arrangement provides a non uniform position specific extension characteristic, an approximation of which is shown by the curve 216 in FIG. 25. An understanding of the localized position based extension of the progressive surround arrangement can be understood by correlating the plot of the curve 216 in FIG. 25 with the relative movement of the centerpiece and surround portions as shown in FIGS. 28, 28A, 28B, and 28C. A relaxed unextended condition of a passive radiator is shown in FIG. 28, where dashed line 230 correlates to the centerline of the frame and centerpiece 232 in an at rest condition and where line 234 provides a relative position reference for the position of the middle surround 236. On FIG. 25 this condition is represented by the origin (position 0,0). When a first level excursion (extension) takes place as is shown in FIG. 28A , the interrelationship of the overall stiffnesses of the three adjacent surrounds causes the perimeter surround 238 to be stretched to its travel limit at a first correlative rate, while the middle surround 236 and the inner surround 240, are stretched very little and almost not at all, respectively. The first correlative rate, might be considered to be an approximation of a spring constant which correlates to the movement of the centerpiece 232 from its at rest position to be displaced a distance 242 which shows that the movement of the centerpiece is due to the extension of the outer surround 238. The displacement of the centerpiece to this first level correlates to the portion of the curve 216 that goes from the origin to a comer of the curve identified adjacent a vertical reference line 244 on FIG. 25. If the total available travel of the centerpiece is identified as being 100% which correlates to 1.0 in this example, then it can be seen from FIG. 25 that the relative travel due to extension of primarily the outer surround exceeds 60% of the total available travel. Thus all small excursions and even moderately sized excursions of the centerpiece occur at the outer perimeter of the structure in the outer surround thus providing a localized position based extension. The distance 242 shown in FIG. 28A correlates approximately to the curve position associated with the reference line 244.

In FIG. 28A reference line 246 correlates to the position of the inner surround 240 a the first level extension shown in FIG. 28A.

FIG. 28B shows a second level extension of the centerpiece 232 of the passive radiator. In this condition , the outer surround 238 which had formerly been stretched to the limit of it travel, stretches no more. The additional travel of the centerpiece, through a distance 248, occurs primarily by stretching of the middle surround 236, with very little stretching of the stiff inner surround 240. The increased force needed to stretch the middle surround (stiffness) causes the curve 216 relating to the movement of the centerpiece to turn a comer (at 244) and move at an increased rate upward to a curve position correlating to the reference line 250 on FIG. 25. At this position, the middle surround 236 has reached the limit of its travel. A reference line 252 corresponding to the vertical position of the bottom of the centerpiece 232 at this second level position is identified in FIG. 28B.

FIG. 28C shows the fully extended third level position of the centerpiece 232 showing the vertical travel distance over the second level position as shown in FIG. 28B. To reach this position, since both the outer 238 and middle 236 surrounds had reached the limits of their travel only the inner surround is subject to stretching. This stretching occurs over the distance 254, which correlates to the portion of the curve 216 to the right of the reference line 250. Curve 216 again turns a corner (at 250) and requires a markedly increased rate of force versus extension to achieve full travel. The result being that while the general overall characteristics of the progressive roll configuration exhibits a similar overall appearance, the actual performance due to the localized position based extension substantially reduces the chance that wobble (as sound distortion) will be heard at low sound pressure levels without unduly limiting the ability of the passive to resonate at relatively high sound pressure levels without audible distortion which results in improved sound quality.

As shown in the FIG. 28 series, vent opening between adjacent surround compartment allow for pressure equalization and/or venting. Several other configurations will be discussed below.

The sizing of the surrounds closest to the perimeter compared with the surrounds positioned closer to the center of the vibrating element depends on two important considerations:

1. Linear stiffness whereby the closest to the perimeter (next to the frame) surround will approach maximum excursion just as the range of excursion for the next adjacent surround begins a larger relative motion. This is necessary to produce distortion free response. It this is not respected a harmonic distortion will overwhelm the fundamental signal and will create a complex signal out of a single tone.
2. The outer roll diameter, whereby the piston diameters relates to the amount of movement for a particular piston and roll diameter. Also the second (inside the outer) roll diameter and the second piston diameter are related in a similar way. Furthermore the outer roll diameter and the inner roll diameter are related to each other in a proportional way such that the outer roll is larger than the inner one following the arc of sphere or a cone (e.g., the inner is no greater than 80% of the diameter of the immediately adjacent outer roll diameter). Once the outer diaphragm diameter (Do—diameter outer) is selected (see FIG. 25C) and a maximum excursion distance associated with the outer piston (the diameter to the outside of the selected surround) is selected the configuration of the progressive roll arrangement is set. Since the maximum axis travel equates to approximately 70% of the corresponding roll diameter (dro—diameter roll outer) a ratio of $$\frac{Do}{dro}$$

roll diameter is set and the distance to the next diaphragm inside the outer one is set, approximately correlating to Do minus dro. Using the three surround example, the middle surround has a piston diameter (Dm—diameter middle) and a corresponding roll diameter (drm—diameter roll middle) such that the ratio $$\frac{Do}{dro} \approx \frac{Dm}{drm}$$

holds true as surrounds progressively get smaller toward the center. These ratios of geometric quantities in practice are dependent on material properties and transitional variations and thus are approximately equally rather than being exactly so. There will be an optimum value for the next roll diameter based on the air quantity moved and speed (i.e., surround stiffness).

Figure 29:
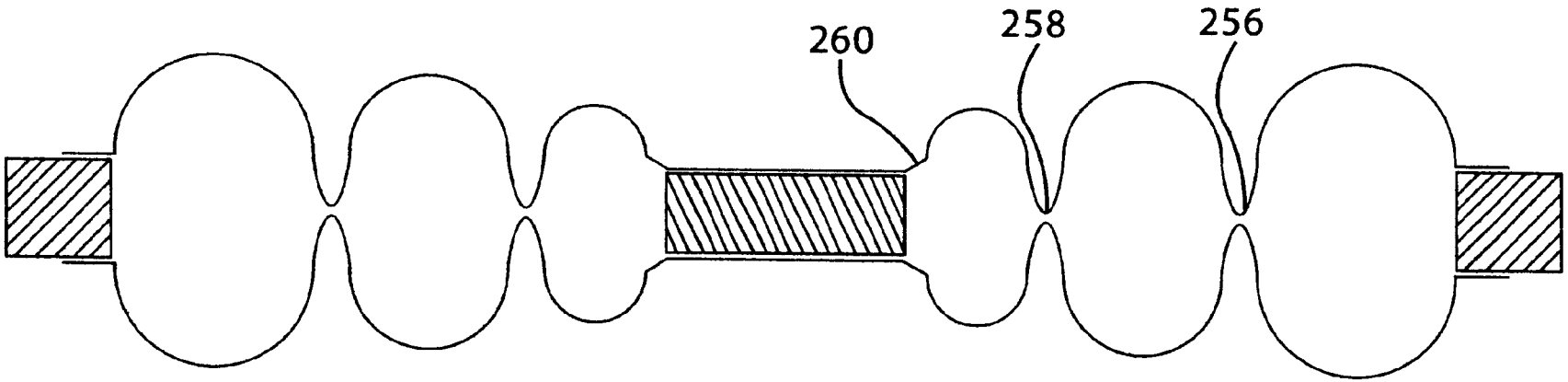
FIG. 29 shows a cross sectional schematic view according to the invention where three progressively sized surrounds contact each other at their saddles.

FIG. 29 shows a schematic cross sectional view of an embodiment of a progressive passive roll according to the invention where surrounds symmetrically mounted in opposing directions are connected by a series of smooth release transitions 256, 258, 260 to avoid material concentration and the elongation discontinuities associated with stresses and strains through such material concentrations.

Figure 30:
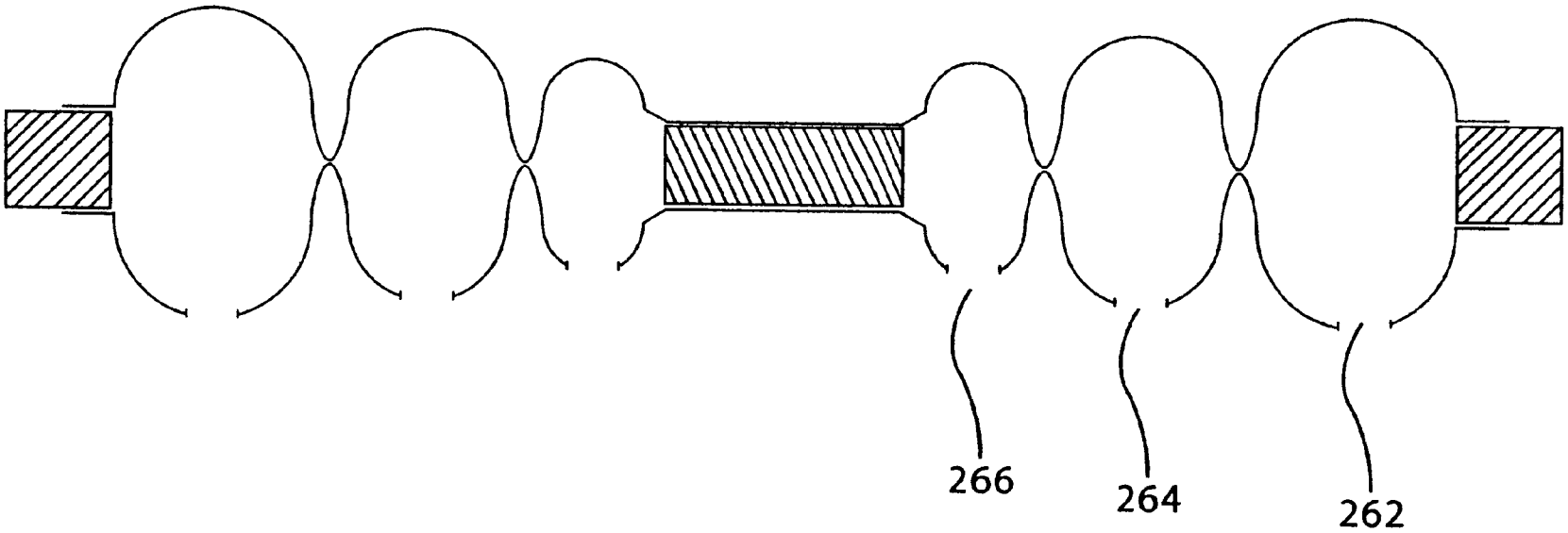
FIG. 30 shows a view of FIG. 29 with the addition of vent features for a device according to the invention.

During long strokes, the air trapped between the diaphragms can a high pressure secondary cabinet that slows down the response. To eliminate this problem, air ventilation holes are made in the inside diaphragm (similar to that described above). The ventilation hole must have enough window area to allow air to pass at a speed of no more than 12 ft/sec (approx. 1% of the speed of sound). These holes must be symmetrical so that they do not pose a bias to the surrounds. FIG. 30 shows the configuration as shown in FIG. 29 modified to have vent opening 262, 264, 266 through a face of the several surrounds, similar to that described above for the single surround arrangement (e.g., FIG. 20).

Figure 31:
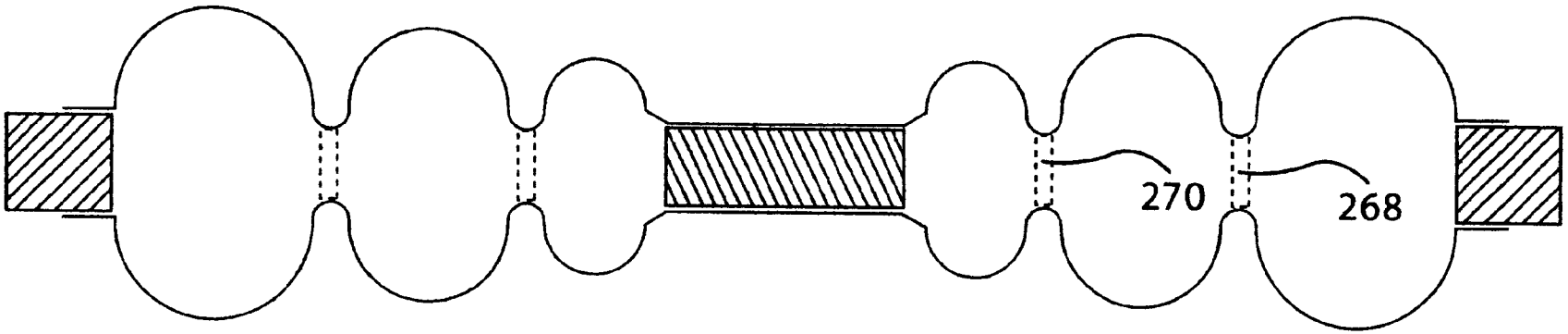
FIG. 31 shows a cross sectional schematic view according to the invention where three progressively sized surrounds are separated from each other at their saddles by spacers which maintain the distance between saddles.

FIG. 31 shows a schematic cross sectional diagram of a progressive roll arrangement, as previously described, where the centerpiece and frame vertical thickness are greater to reduce the chance of sideways motion and the related distortion. To prevent collapse (buckling) of the surround elements, a series of vertical spacers 268, 270, comprising vertical cylinders mating the valley bottoms between surround roll peaks together are provided. These spacers 268, 270 can be a thin Mylar sheet or other comparable material whose effect is only to keep the corresponding connections on the upper and lower surrounds at equidistant to one another. In general it is preferred to have the spacer to be so lightweight that the oscillatory reaction of the surrounds is unchanged from what they would be without the spacer, except that out of phase and collapse conditions are avoided.

Figure 32:
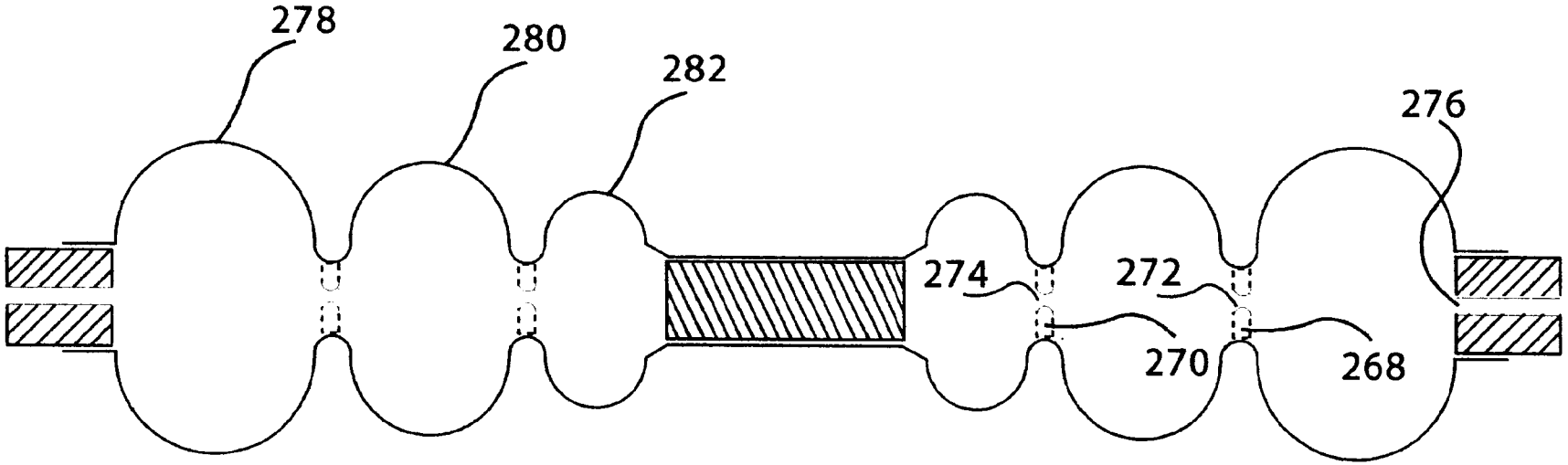
FIG. 32 shows a view of FIG. 31 with the addition of vent features for a device according to the invention.

FIG. 32 provides a vented configuration of the embodiment as shown in FIG. 31. The vents are holes 272, 274 through the wall of the spacers 268, 270 with a set of perimeter flange holes 276 providing surface area to allow air movement without generating audible notice of the movement.

Figure 33:
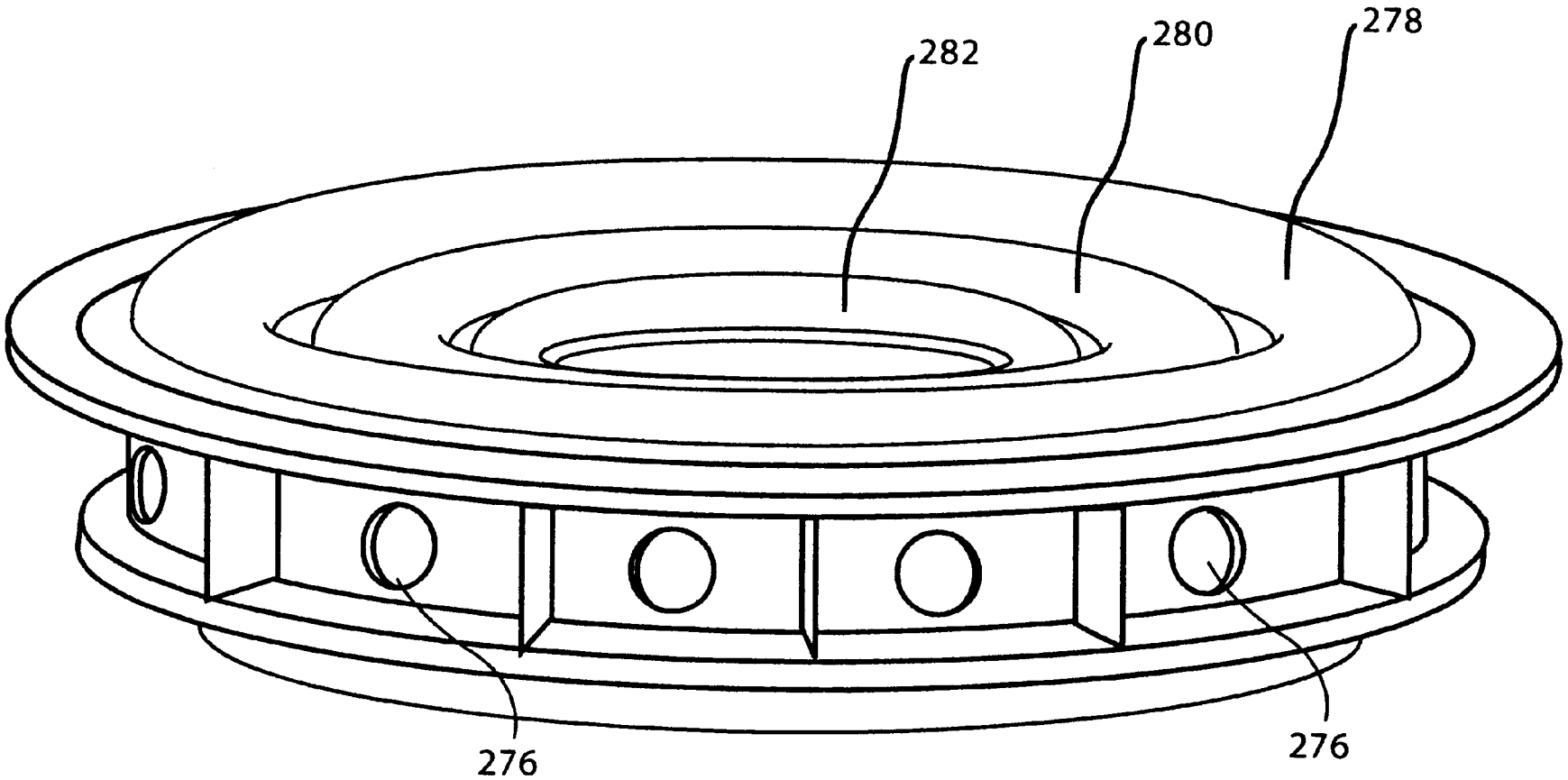
FIG. 33 shows a perspective view of a passive radiator incorporating three progressively sized surrounds as pictured in cross section in earlier Figures.

FIG. 33 presents a physical realization of the embodiment of FIG. 32. The Perimeter flange holes 276 are shown distributed around the perimeter flange and the progressive surround roll diameters 278, 280, 282, correlating to these structures in FIG. 32 are illustrated.

Tube Arrangement

Figure 34:
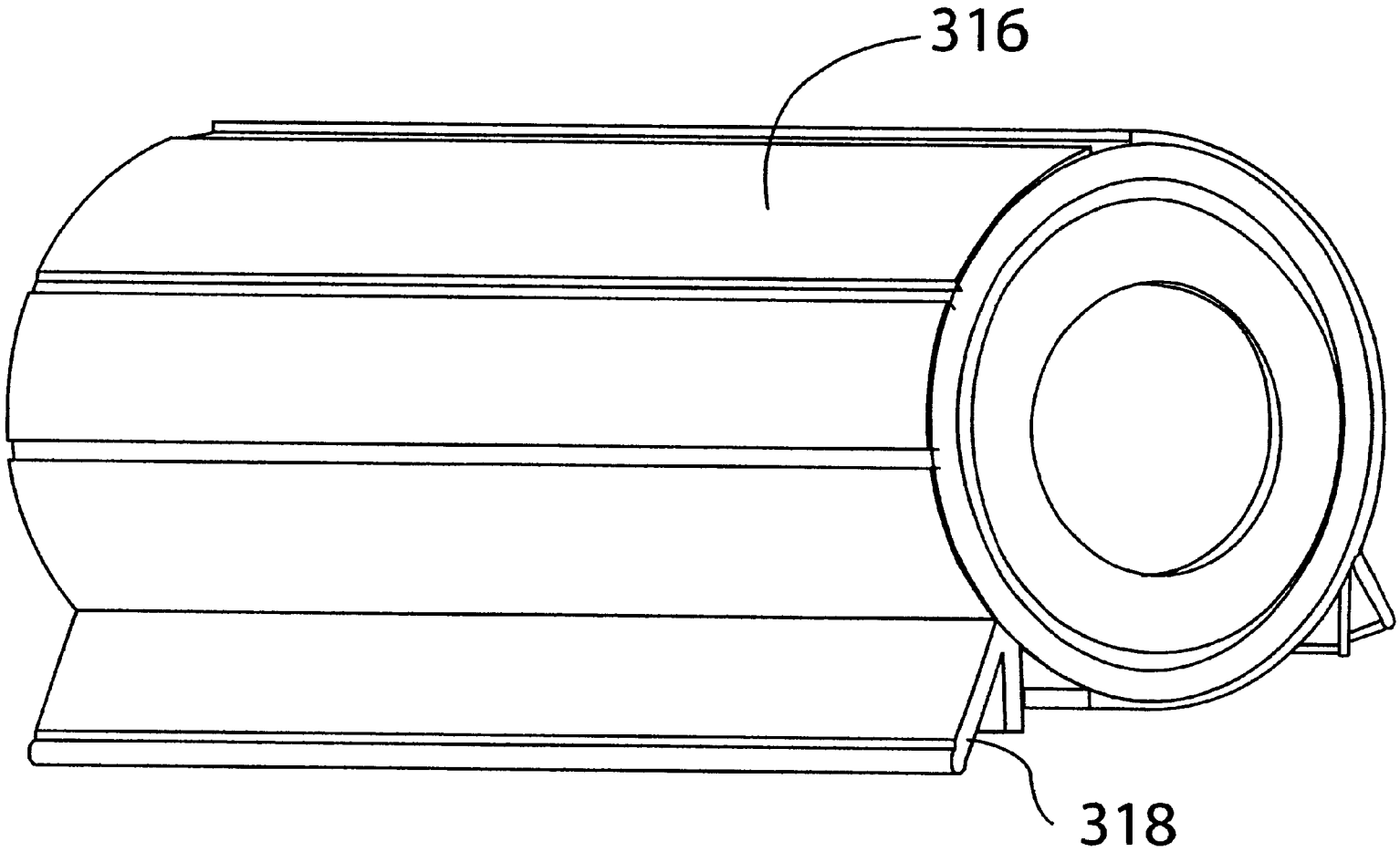
FIG. 34 a perspective view of a sound transducer system (speaker system) contained in a tube enclosure.
Figure 35:
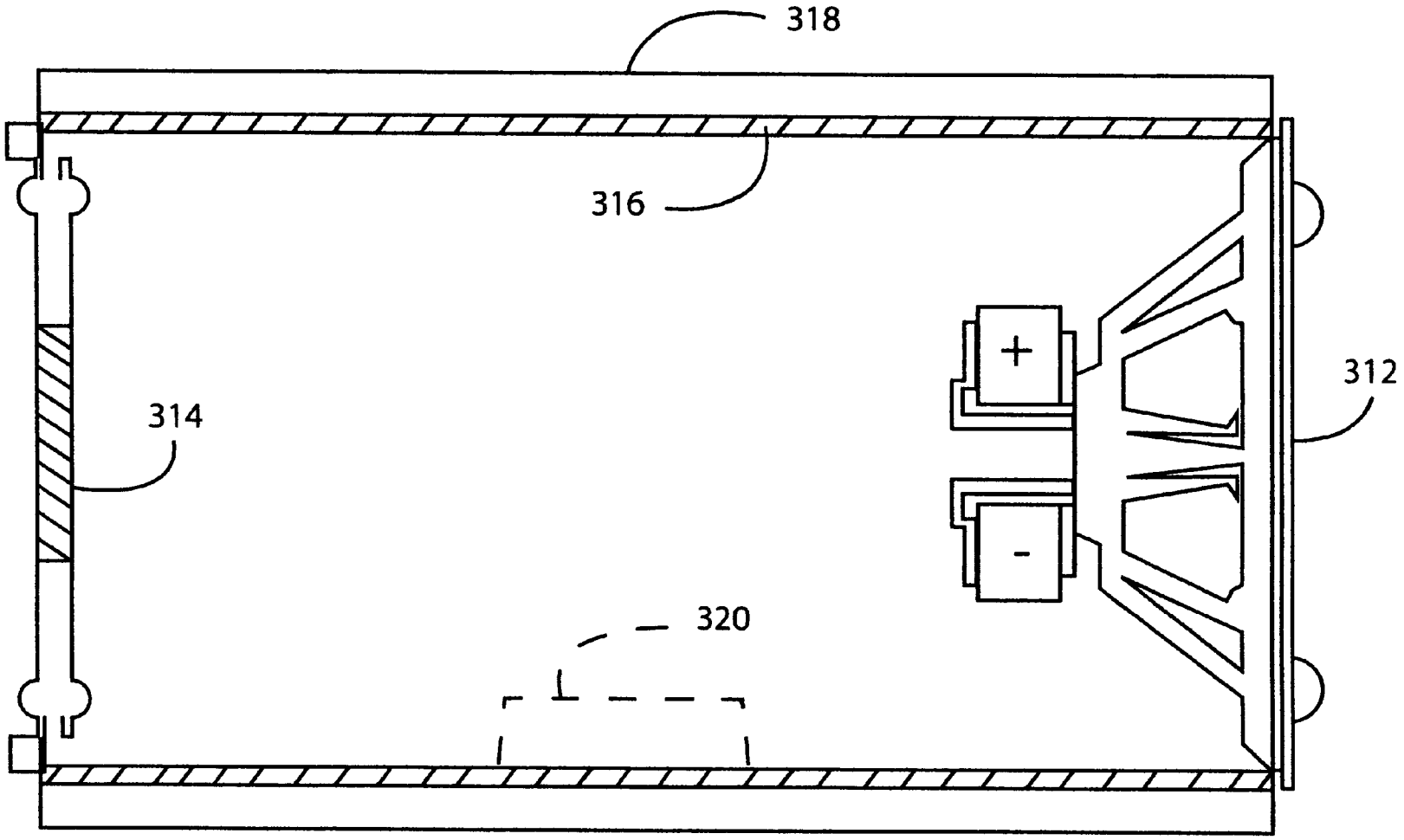
FIG. 35 is a schematic cross sectional view of the tube enclosure for the speaker system of FIG. 34, with an active element at one end and a passive element at the other end, the tube is made of aluminum, and may have fins to assist in cooling.

Another configuration according to the invention, showing a speaker and a passive radiator in an enclosure is shown in FIGS. 34 and 35. A speaker enclosure, not unlike the speaker boxes of FIGS. 21, 22, 23, and 24, is specially configured in a tube shape. A driver (speaker) 312 at one end and a passive radiator 314 according to the invention at the other end. Passive radiators as shown and described in FIGS. 9, 15, 16, 17, 29, 30, 31, 32, and 33 can be used. One of the biggest reasons for failure of voice coils of speakers is embrittlement and insulation breakdown due to high temperatures. In a closed box system where there is no transfer of air between the inside and outside, thermal energy is not dissipated quickly. In the present configuration the tube 316 containing the speaker and driver is made of aluminum and made be fitted with perimeter ribs 318 to enhance cooling. Measurements have show that the temperature of the air inside the tube shows a drop of 5° F. inside the tube at moderate speaker power levels when the ambient surrounding temperature is about 70° F. Such a reduction in voice coil temperature is significant. When an amplifier (e.g., 320) is mounted in the tube as well the air temperature reduction due to the use of a high thermally conductive material such as aluminum will be even more significant.

While the invention has been described with regard to specific embodiments, those skilled in the art will recognize that changes can be made in form and detail without departing from the spirit and scope of the invention.

What is claimed is:

1. A passive radiator comprising:

a frame encircling a mass, said mass being suspended within said frame for movement along an axis of said frame through an outer elastic membrane and an inner elastic membrane disposed symmetrically between said frame and said mass, said elastic membranes are disposed to provide substantial movement of said mass along said axis of said frame and are disposed to resist motions perpendicular to said axis, thus allowing only negligible movement of the mass in a direction perpendicular to said axis;

a pressure vent system that allows air that is trapped in a space between the inner elastic membrane, the outer elastic membrane, between said mass and said frame to move in and out of said space in which it is trapped, at a maximum speed of no greater than 2% of the speed of sound.

2. The passive radiator as in claim 1, wherein said pressure vent system provides air passages through said frame and between said space in which said air is trapped and an inside of a speaker box having an opening in which said frame is mounted.

3. The passive radiator as in claim 1, wherein said pressure vent system provides air port holes through said inner elastic membrane and between said space in which said air is trapped and an inside of a speaker box having an opening in which said frame is mounted.

4. The passive radiator as in claim 1, wherein said pressure vent system provides air port holes through said outer elastic membrane and between said space in which said air is trapped and a space outside of a speaker box having an opening in which said frame is mounted.

5. The passive radiator as in claim 2, further comprising:

a spacer between said outer elastic membrane and said inner elastic membrane intermediate of said mass and said frame disposed to provide a predetermined distance between a portion of said outer elastic membrane fixed to said spacer and a portion of said inner elastic membrane fixed to said spacer.

6. The passive radiator as in claim 3, further comprising a spacer between said outer elastic membrane and said inner elastic membrane intermediate of said mass and said frame disposed to provide a predetermined distance between a portion of said outer elastic membrane fixed to said spacer and a portion of said inner elastic membrane fixed to said spacer.

7. A passive radiator comprising:

a frame encircling a mass, said mass being suspended within said frame for movement along an axis of said frame through an outer elastic membrane and an inner elastic membrane disposed symmetrically between said frame and said mass, said elastic membranes are disposed to provide substantial movement of said mass along said axis of said frame and are disposed to resist motions perpendicular to said axis, thus allowing only negligible movement of the mass in a direction perpendicular to said axis;

wherein said inner elastic membrane consists of two or more speaker surrounds having perimeter diameters which are configured to be approximately concentric with a diameter of said frame, wherein a first surround is disposed adjacent to and inside of said frame, an outer edge of said first surround is attached to said frame, an inner edge of said first surround is disposed a first surround roll diameter distance in toward said mass;

wherein a second surround is disposed adjacent to and inside of said inner edge of said first surround, an outer edge of said second surround is attached to said inner edge of said first surround at a saddle connection between the two, an inner edge of said second surround is disposed a second surround roll diameter distance in toward said mass;

wherein said second surround roll diameter is no greater than 80% of the first surround roll diameter;

wherein said inner edge of said second surround is connected to said mass, the connection between said second surround and said mass may be through additional concentrically configured surrounds, each have a surround roll diameter no greater than 80% of the surround roll diameter of the surround to which it connects at its perimeter, wherein said outer elastic membrane is a mirror image of said inner elastic membrane.

8. The passive radiator as in claim 7, further comprising:

a pressure vent system that allows air that is trapped in isolated compartments created between said inner elastic membrane and said outer elastic membrane, and a space between the said inner elastic membrane, the outer elastic membrane and either said mass or said frame to move in and out of said compartment and space in which it is trapped, at a maximum speed of no greater than 2% of the speed of sound.

9. The passive radiator as in claim 7, further comprising:

a set of cylindrical spacer elements connected between corresponding saddles of surrounds of said inner elastic member and said outer elastic member, thus maintaining a predetermined distance between the saddles of said inner elastic member and said outer elastic member.

10. The passive radiator as in claim 8, further comprising:

a set of cylindrical spacer elements connected between corresponding saddles of surrounds of said inner elastic member and said outer elastic member, thus maintaining a predetermined distance between the saddles of said inner elastic member and said outer elastic member.

11. The passive radiator as in claim 10, wherein said cylindrical spacer elements have holes therein to allow air which would otherwise be trapped in a compartment associated with one surround to move at a maximum speed of no greater than the 2% of the speed of sound into an adjacent surround compartment and in the event the surround compartment is adjacent the frame, then through one or more openings in the frame that communicate with a space outside of said surround roll compartments.

12. A passive radiator comprising:

a frame encircling a mass, said mass being suspended within an opening in said frame for movement along an axis perpendicular to a plane of said frame through an outer elastic membrane and an inner elastic membrane disposed symmetrically between said frame and said mass, said elastic membranes are disposed to provide substantial movement of said mass along said axis of said frame and are disposed to resist motion perpendicular to said axis, thus allowing only negligible movement of the mass in a direction perpendicular to said axis;

wherein said inner elastic membrane consists of two or more speaker surrounds having perimeter diameters which are configured to be approximately concentric with a diameter of said frame, wherein a first surround is disposed adjacent to and inside of said frame, an outer edge having a diameter "Do" of said first surround is attached to said frame, an inner edge of said first surround is disposed a first surround roll diameter distance "dro" in toward said mass;

wherein a second surround is disposed adjacent to and inside of said inner edge of said first surround, an outer edge having a diameter "Dm" of said second surround is attached to said inner edge of said first surround at a saddle connection between the two, an inner edge of said second surround is disposed a second surround roll diameter distance "drm" in toward said mass;

wherein said second surround roll diameter is related to the first surround roll diameter as Do/dro=Dm/drm;

wherein said inner edge of said second surround connects to said mass, the connection between said second surround and said mass may be through additional concentrically configured surrounds, each successive surround having a surround. roll diameter corresponding with a size that corresponds to the ratio of the surround roll diameter to the outer edge diameter of the surround to which it connects at its perimeter;

wherein said outer elastic membrane is a mirror image of said inner elastic membrane.

13. The passive radiator as in claim 12, wherein said saddle connection between adjacent surrounds is configured to be a smooth release.

14. The passive radiator as in claim 7, wherein said saddle connection between adjacent surrounds is configured to be a smooth release.

* * * * *